US010876774B2

(12) United States Patent
Wada

(10) Patent No.: US 10,876,774 B2
(45) Date of Patent: Dec. 29, 2020

(54) ACCUMULATOR

(71) Applicant: DAIKIN INDUSTRIES, LTD., Osaka (JP)

(72) Inventor: Hikaru Wada, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/504,429

(22) PCT Filed: Aug. 7, 2015

(86) PCT No.: PCT/JP2015/072480
§ 371 (c)(1),
(2) Date: Feb. 16, 2017

(87) PCT Pub. No.: WO2016/027700
PCT Pub. Date: Feb. 25, 2016

(65) Prior Publication Data

US 2017/0234588 A1 Aug. 17, 2017

(30) Foreign Application Priority Data

Aug. 22, 2014 (JP) ..... 2014-169897

(51) Int. Cl.
*F25B 43/00* (2006.01)

(52) U.S. Cl.
CPC ..... *F25B 43/006* (2013.01); *F25B 2500/12* (2013.01); *F25B 2500/13* (2013.01)

(58) Field of Classification Search
CPC .... F25B 43/006; F25B 43/00; F25B 2400/03; F25B 2400/23; F25B 2400/16; F24F 1/12;
(Continued)

(56) References Cited

U.S. PATENT DOCUMENTS 5,507,159 A * 4/1996 Cooksey ..... F04B 39/0055 417/312
6,220,050 B1 * 4/2001 Cooksey ..... F04B 39/0061 62/503

FOREIGN PATENT DOCUMENTS

JP 58126487 A * 7/1983 ..... F04B 39/0055
JP 58-158383 * 9/1983
(Continued)

OTHER PUBLICATIONS

International Preliminary Report of corresponding PCT Application No. PCT/JP2015/072480 dated Aug. 7, 2015.
(Continued)

*Primary Examiner* — Joseph F Trpisovsky
(74) *Attorney, Agent, or Firm* — Global IP Counselors, LLP

(57) ABSTRACT

An accumulator to separates gas refrigerant and liquid refrigerant. The accumulator includes a casing, and a resonance-suppressing member installed in an internal space of the casing. The casing has a cylinder portion having a cylinder axis extending along a vertical direction, an upper lid portion linked with an upper end of the cylinder portion, and a lower lid portion linked with a lower end of the cylinder portion. The resonance-suppressing member is installed at a height position that, in a case in which a standing wave of pressure having a first antinode, a node, and a second antinode from the upper lid portion toward the lower lid portion is generated in the internal space, is near a height position of at least one of the first antinode and the second antinode.

5 Claims, 25 Drawing Sheets

(58) Field of Classification Search
CPC ..... F24F 1/40; F24F 2013/247; F16L 55/02; F16L 55/033; F16L 55/0336; F16L 55/0338
USPC ..... 62/503
See application file for complete search history.

(56) References Cited

FOREIGN PATENT DOCUMENTS

| | | | |
|---|---|---|---|
| JP | S63-014963 | U | 1/1988 |
| JP | H03-83779 | U | 8/1991 |
| JP | 7-218047 | A | 8/1995 |
| JP | 2008-202879 | A | 9/2008 |
| JP | 2010-097149 | A | 4/2010 |
| KR | 10-2009-0100157 | A | 9/2009 |

OTHER PUBLICATIONS

International Search Report of corresponding PCT Application No. PCT/JP2015/072480 dated Nov. 2, 2015.
European Search Report of corresponding EP Application No. 15 83 3419.3 dated Feb. 19, 2018.

* cited by examiner

ACCUMULATOR

CROSS-REFERENCE TO RELATED APPLICATIONS

This U.S. National stage application claims priority under 35 U.S.C. § 119(a) to Japanese Patent Application No. 2014-169897, filed in Japan on Aug. 22, 2014, the entire contents of which are hereby incorporated herein by reference.

TECHNICAL FIELD

The present invention relates to an accumulator that is installed near a compressor, and that separates a gas-liquid two-phase refrigerant into gas refrigerant and liquid refrigerant.

BACKGROUND ART

Recently, air conditioners are being provided with accumulators installed near compressors. An accumulator separates a gas-liquid two-phase refrigerant drawn into the compressor into gas refrigerant and liquid refrigerant, and prevents the liquid refrigerant from flowing into the compressor.

SUMMARY

A compressor uses a compression mechanism installed therein to periodically drawn in gas refrigerant from the accumulator. The pressure of the gas refrigerant is thereby caused to fluctuate in an internal space in a casing of the accumulator. This pressure fluctuation causes resonance with the casing, and as a result, internal space resonance of 400 Hz to 900 Hz occurs in the internal space of the casing. The internal space resonance causes vibration in the accumulator. Therefore, various methods for eliminating internal space resonance have been employed. For example, in Japanese Unexamined Utility Model Publication No. H3-83779, two resonance-suppressing members are installed in the internal space of the casing. These resonance-suppressing members, which are installed near the lengthwise center of the casing, have the effect of reducing internal space resonance. However, vibration in the accumulator may not be sufficiently reduced even though these resonance-suppressing members have been installed.

The purpose of the present invention is to provide an accumulator with which resonance caused by pressure fluctuation in the internal space of the casing can be eliminated and noise can be reduced.

An accumulator according to a first aspect of the present invention is a device for separating gas refrigerant and liquid refrigerant. The accumulator comprises a casing and a resonance-suppressing member. The resonance-suppressing member is installed in an internal space of the casing. The casing has a cylinder portion having a cylinder axis running along a vertical direction, an upper lid portion linked with an upper end of the cylinder portion, and a lower lid portion linked with a lower end of the cylinder portion. The resonance-suppressing member is installed at a height position that, in a case in which a standing wave of pressure having a first antinode, a node, and a second antinode from the upper lid portion toward the lower lid portion is generated in the internal space, is near to the height position of at least one of the first antinode and the second antinode.

In the accumulator according to the first aspect, resonance-suppressing members are attached at height positions near to the upper end and lower end of the cylinder portion of the casing. A standing wave is generated in the internal space as a result of pressure fluctuation in the gas refrigerant. The standing wave has a first antinode, a node, and a second antinode from the upper lid portion toward the lower lid portion. The height positions near to the upper end and lower end of the cylinder portion are height positions where, respectively, the first antinode and second antinode of the standing wave are present, and where pressure fluctuation reaches a maximum. In other words, the resonance-suppressing members are attached at height positions near to the height positions where pressure fluctuation reaches a maximum. The resonance-suppressing members have the effect of hindering pressure fluctuation. Therefore, by attaching the resonance-suppressing members at height positions where pressure fluctuation reaches a maximum in the internal space; i.e., height positions near to the upper end and lower end of the cylinder portion, the maximum value of the pressure fluctuation amplitude can be reduced, and resonance caused by pressure fluctuation can be eliminated. As a result, casing vibration is minimized, and noise emitted from the accumulator during operation is reduced.

An accumulator according to a second aspect of the present invention is the accumulator according to the first aspect. When the resonance-suppressing member is installed at a height position near to the height position of the first antinode, the resonance-suppressing member is installed in a range from the height position of the upper end of the cylinder portion to a height position set apart by a distance of 25% of the dimension of the cylinder portion along the direction of the cylinder axis from the upper end of the cylinder portion toward the lower end. When the resonance-suppressing member is installed at a height position near to the height position of the second antinode, the resonance-suppressing member is installed in a range from the height position of the lower end of the cylinder portion to a height position set apart by a distance of 25% of the dimension of the cylinder portion along the direction of the cylinder axis from the lower end of the cylinder portion toward the upper end.

An accumulator according to a third aspect of the present invention is the accumulator according to the first aspect or second aspect, wherein the resonance-suppressing member is an annular member attached to an internal peripheral surface of the cylinder portion.

With the accumulator according to the first through third aspects of the present invention, resonance caused by pressure fluctuation in the internal space of the casing can be eliminated and noise can be reduced.

DESCRIPTION OF EMBODIMENTS

An accumulator 11 according to an embodiment of the present invention shall be described with reference to the drawings.

(1) Configuration of Accumulator

Figure 1:
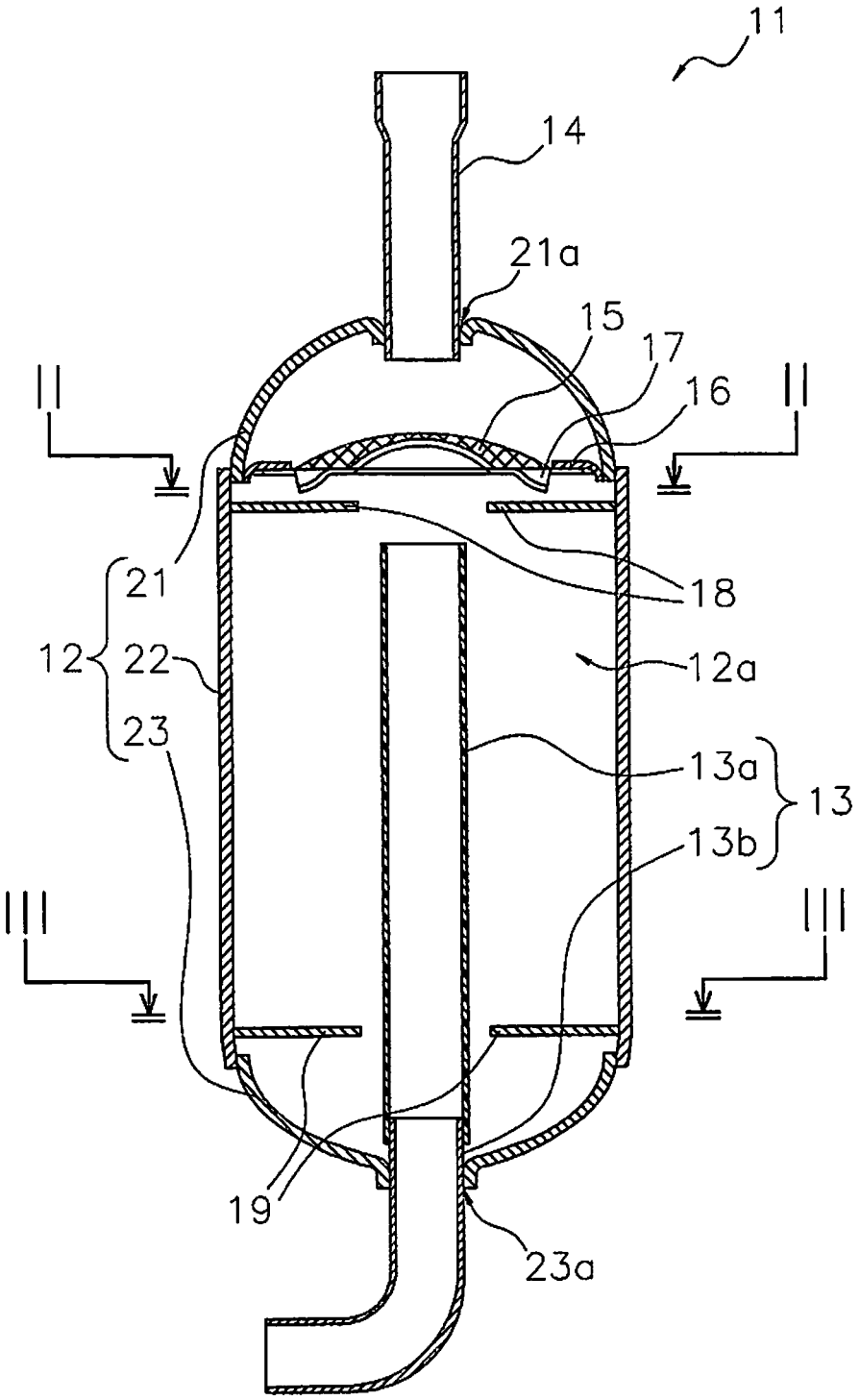
FIG. 1 is a longitudinal cross-sectional view of an accumulator according to an embodiment of the present invention.

FIG. 1 is a longitudinal cross-sectional view of the accumulator 11. The accumulator 11 is provided to a refrigerant circuit of an air conditioning apparatus, etc. In the refrigerant circuit, the accumulator 11 is connected to an intake side of a compressor 101, described hereinafter.

The accumulator 11 separates the gas-liquid two-phase refrigerant drawn into the compressor 101 into gas refrigerant and liquid refrigerant, and prevents the liquid refrigerant from flowing into the compressor 101. The refrigerant is, e.g., R410A and R32. The accumulator 11 is mainly provided with a casing 12, an outlet tube 13, an inlet tube 14, a filter 15, a holder 16, a baffle 17, and two resonance-suppressing members 18, 19.

(1-1) Casing

The casing 12 is a metal airtight container in which a dome-shaped upper lid portion 21, a cylinder portion 22 in the shape of a cylinder, and a dome-shaped lower lid portion 23 are hermetically joined together. The casing 12 has an internal space 12*a* that is a space enclosed by the upper lid portion 21, the cylinder portion 22, and the lower lid portion 23. The upper lid portion 21 has an inlet hole 21*a*. The lower lid portion 23 has an outlet hole 23*a*. The gas-liquid two-phase refrigerant flows into the internal space 12*a* from the inlet hole 21*a*. The gas refrigerant separated from the gas-liquid two-phase refrigerant flows out from the outlet hole 23*a* to be sent to the compressor 101.

(1-2) Outlet Tube

The outlet tube 13 is attached to the outlet hole 23*a* of the lower lid portion 23 of the casing 12. The outlet tube 13 is configured from an internal outlet tube 13*a* and an external outlet tube 13*b*. The internal outlet tube 13*a*, which is accommodated within the internal space 12*a* of the casing 12, extends vertically. The external outlet tube 13*b*, which is hermetically joined to the internal periphery of the outlet hole 23*a*, extends from the outlet hole 23*a* toward the space outside of the casing 12. The external outlet tube 13*b* is connected to the compressor 101. The lower end part of the internal outlet tube 13*a* is joined to the end part of the external outlet tube 13*b* that is inside the internal space 12*a*. The upper end part of the internal outlet tube 13*a* is positioned above the height position of the vertical center of the casing 12.

(1-3) Inlet Tube

The inlet tube 14 is attached to the inlet hole 21*a* in the upper lid portion 21 of the casing 12. The inlet tube 14, which is hermetically joined to the internal periphery of the inlet hole 21*a*, extends from the inlet hole 21*a* toward the space outside of the casing 12. The inlet tube 14 is connected to a pipe (not shown) of the refrigerant circuit in the space outside of the casing 12.

(1-4) Filter

The filter 15 is accommodated within the internal space 12*a* of the casing 12. The filter 15 is a member for filtering the refrigerant flowing in from the inlet hole 21*a* in the upper lid portion 21 of the casing 12, and removing impurities that have contaminated the refrigerant. The filter 15 is, e.g., a metal mesh.

(1-5) Holder

The holder 16 is accommodated within the internal space 12*a* of the casing 12. The holder 16 is a metal member for securing the filter 15 to a predetermined position in the internal space 12*a*. The holder 16 is attached to an inner-side surface of the upper lid portion 21.

(1-6) Baffle

The baffle 17 is accommodated within the internal space 12*a* of the casing 12. The baffle 17 is a thin metal sheet for preventing the liquid component of the refrigerant flowing in from the inlet hole 21*a* in the upper lid portion 21 of the casing 12 from flowing directly into the outlet tube 13. The middle portion of the baffle 17 is shaped to protrude vertically upward. The baffle 17 is attached to the inner-side surface of the upper lid portion 21 below the filter 15.

(1-7) Resonance-Suppressing Members

Figure 2:
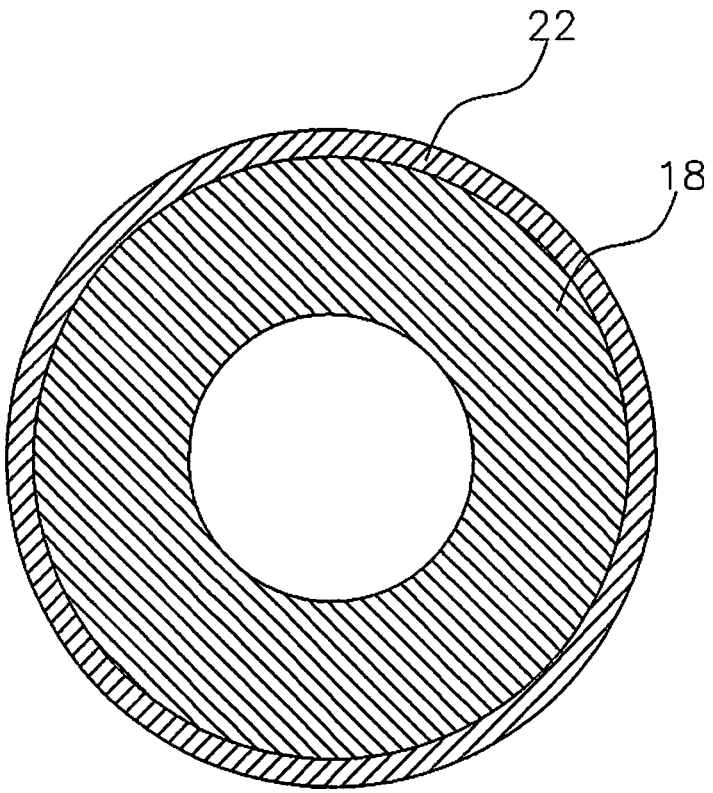
FIG. 2 is a cross-sectional view in the height position indicated by the arrows II in FIG. 1.
Figure 3:
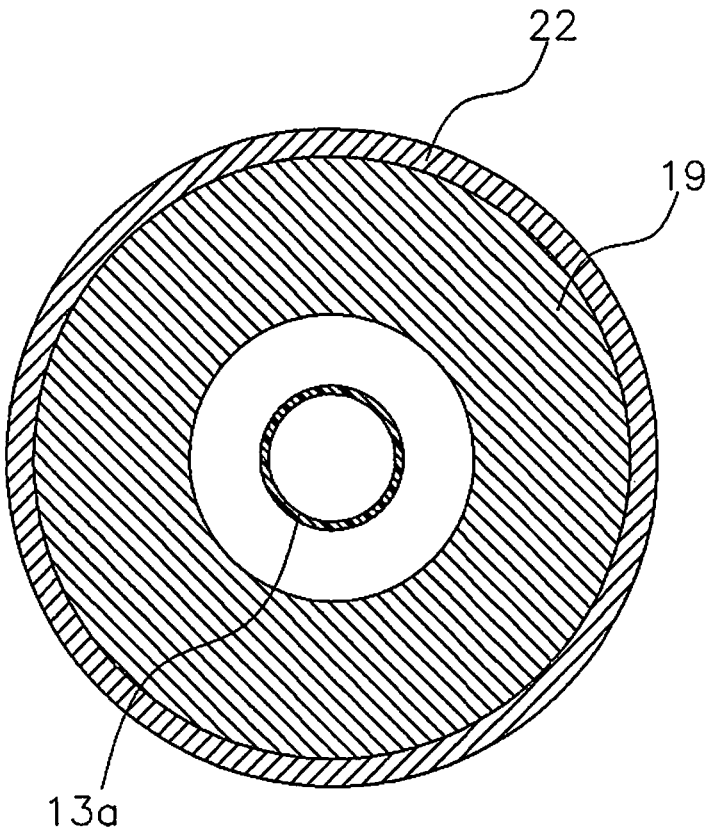
FIG. 3 is a cross-sectional view in the height position indicated by the arrows III in FIG. 1.

The resonance-suppressing members 18, 19 are thin metal sheets accommodated within the internal space 12*a* of the casing 12 and attached to an internal peripheral surface of the cylinder portion 22 of the casing 12. FIG. 2 is a cross-sectional view in the height position indicated by arrows II in FIG. 1. FIG. 3 is a cross-sectional view in the height position indicated by arrows III in FIG. 1. The resonance-suppressing members 18, 19 are annular members attached respectively to the upper portion and lower portion of the casing 12, as shown in FIGS. 2 and 3. The entirety of the external peripheral surfaces of the resonance-suppressing members 18, 19 are joined to the internal peripheral surface of the cylinder portion 22, whereby the resonance-suppressing members 18, 19 are secured to the casing 12. Hereinafter, if necessary, the top resonance-suppressing member 18 shown in FIG. 2 is referred to as the upper resonance-suppressing member 18, and the bottom resonance-suppressing member 19 shown in FIG. 3 is referred to as the lower resonance-suppressing member 19.

Figure 4:
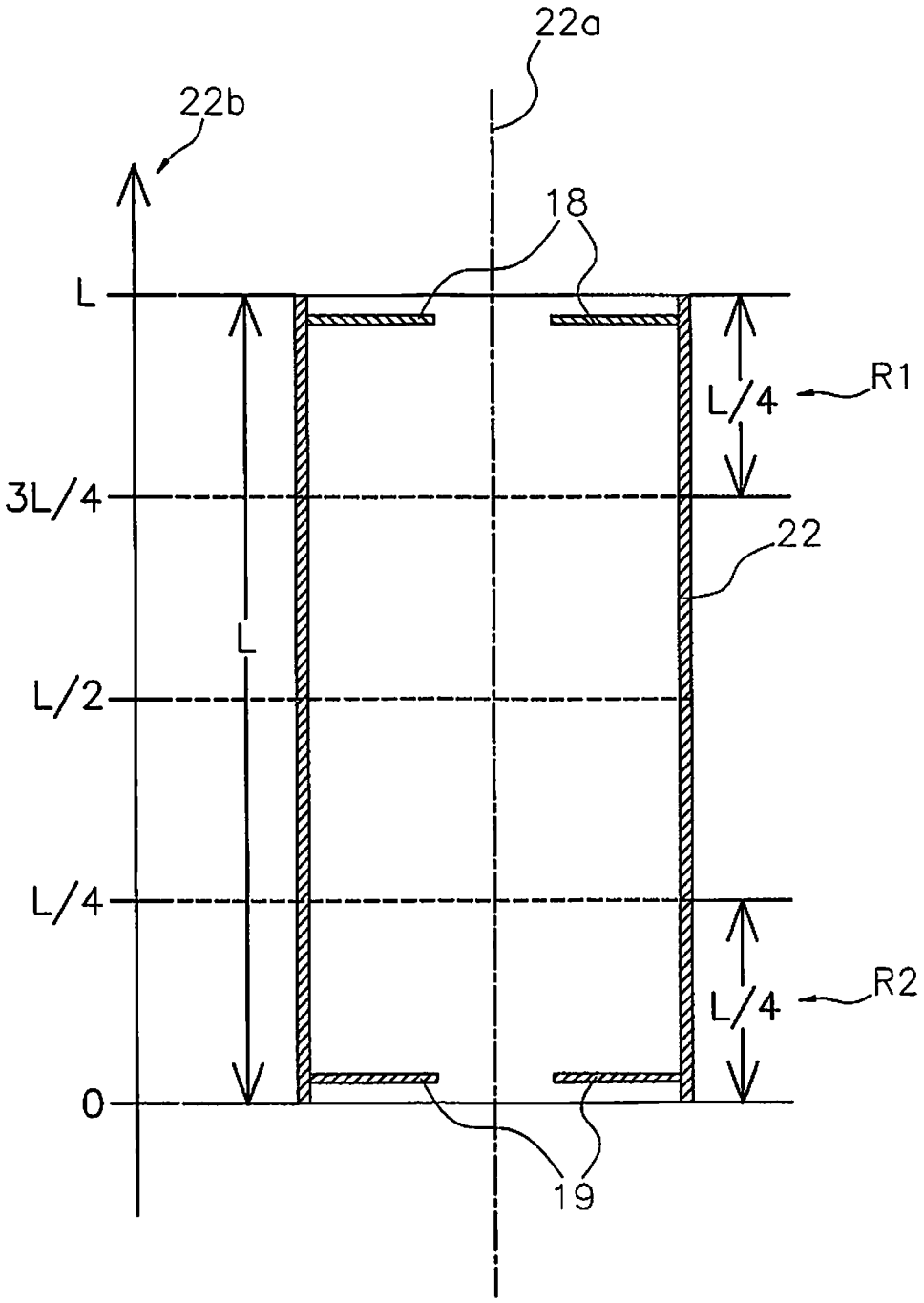
FIG. 4 is a drawing for illustrating the height positions of the resonance-suppressing members.

The upper resonance-suppressing member 18 is attached to a height position near the portion where the upper lid portion 21 and the cylinder portion 22 are joined. The lower resonance-suppressing member 19 is attached to a height position near the portion where the cylinder portion 22 and the lower lid portion 23 are joined. The height positions of the upper resonance-suppressing member 18 and the lower resonance-suppressing member 19 shall now be described. FIG. 4 illustrates the height positions of the upper resonance-suppressing member 18 and the lower resonance-suppressing member 19 attached to the cylinder portion 22. FIG. 4 shows a longitudinal cross-sectional view of the cylinder portion 22 only. In FIG. 4, the cylinder portion 22 is schematically shown as a circular column. FIG. 4 shows a cylinder axis 22*a* that links the center of the upper surface and the center of the lower surface of the cylinder portion 22. The cylinder axis 22*a* is parallel to the vertical direction.

The vertical dimension of the cylinder portion 22 is denoted below as L, the height position of the lower end of the cylinder portion 22 as zero, and the height position of the upper end of the cylinder portion 22 as L. A vertical coordinate axis 22*b* representing the height position is shown on the left side in FIG. 4. For example, the height position of the vertical center of the cylinder portion 22 is L/2. The height position of the upper resonance-suppressing member 18 is within a range of 3L/4 to L, and is preferably as close as possible to L. The height position of the lower resonance-suppressing member 19 is within a range of zero to L/4, and is preferably as close as possible to zero. In FIG. 4, the range of height positions from 3L/4 to L is shown as R1, and the range of height positions from zero to L/4 is shown as R2.

In other words, the upper resonance-suppressing member 18 is installed in the range R1 from the height position (L) of the upper end of the cylinder portion 22 to the height position (3L/4), which is set apart by a distance of 25% of the dimension L of the cylinder portion 22 along the direction of the cylinder axis 22*a* from the upper end of the cylinder portion 22 to the lower end. The lower resonance-suppressing member 19 is installed in the range R2 from the height position (zero) of the lower end of the cylinder portion 22 to the height position (L/4), which is set apart by a distance of 25% of the dimension of the cylinder portion 22 along the direction of the cylinder axis 22*a* from the lower end of the cylinder portion 22 to the upper end.

(2) Configuration of Compressor

Figure 5:
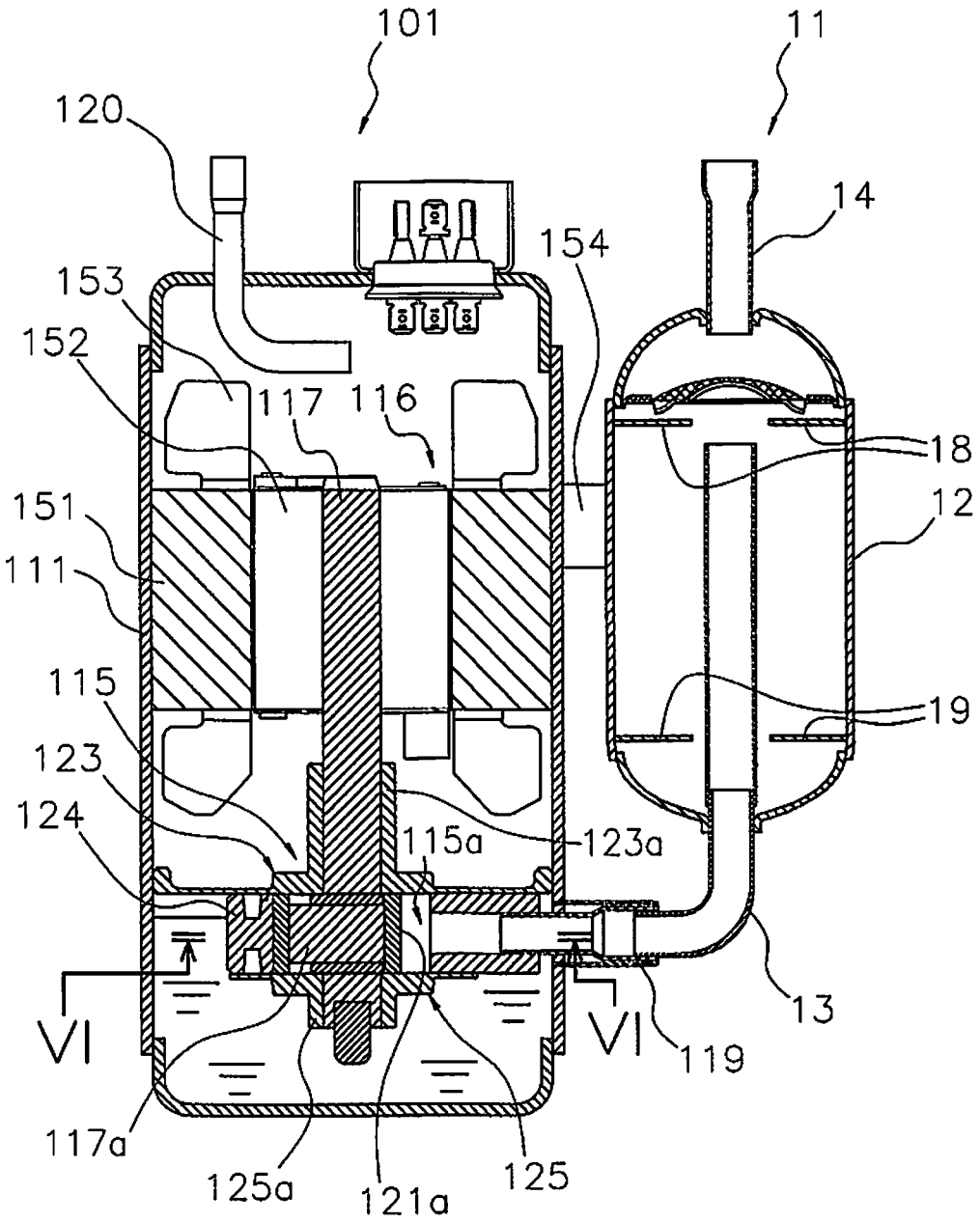
FIG. 5 is a longitudinal cross-sectional view of a compressor to which the accumulator is connected.

Next, the configuration of the compressor 101 connected to the accumulator 11 shall be described. FIG. 5 is a longitudinal cross-sectional view of the compressor 101. The compressor 101 is a swing-type compressor. The compressor 101 is mainly configured from a compressor casing 111, a compression mechanism 115, a drive motor 116, a crankshaft 117, an intake tube 119, and a discharge tube 120.

(2-1) Compressor Casing

The compressor casing 111 is a vertically extending cylindrically shaped metal airtight container. The compressor casing 111 mainly accommodates the compression mechanism 115 and the drive motor 116. The compression mechanism 115 and the drive motor 116 are linked by the crankshaft 117. The crankshaft 117 is disposed in the internal space of the compressor casing 111 so as to extend vertically. Attached to the external peripheral surface of the compressor casing 111 is an accumulator support base 154 for securing the accumulator 11 to the compressor 101.

(2-2) Compression Mechanism

Figure 6:
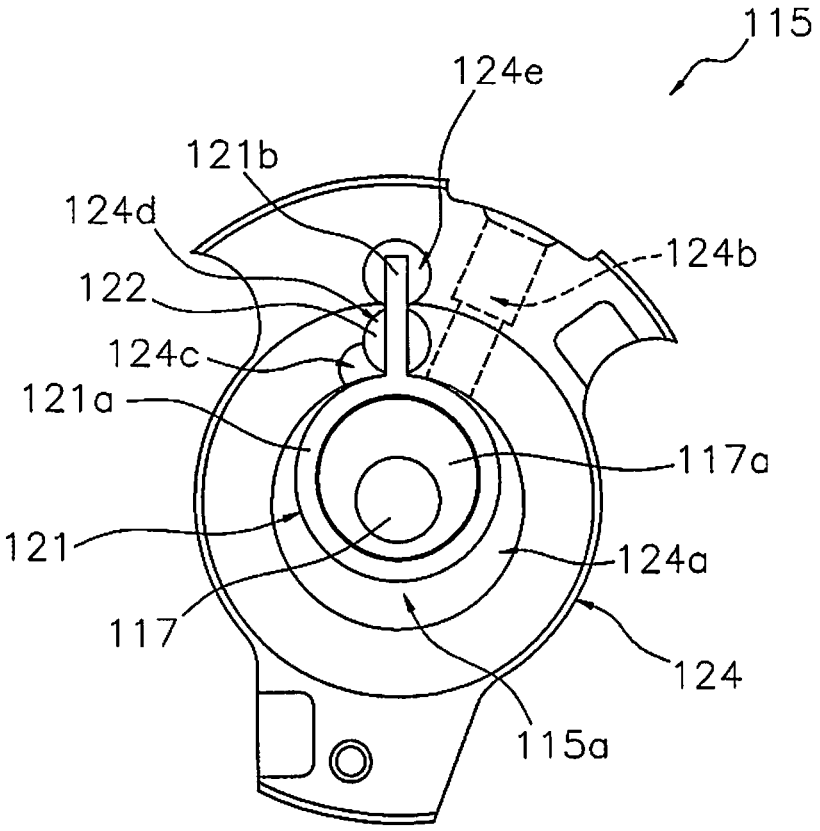
FIG. 6 is a cross-sectional view at the height position indicated by the arrows VI in FIG. 5.

The compression mechanism 115 is mainly configured from a piston 121, a bushing 122, a front head 123, a cylinder block 124, and a rear head 125. The compression mechanism 115 is immersed in refrigerator oil stored in a bottom part of the compressor casing 111. The refrigerator oil is lubricating oil supplied to sliding parts of the compression mechanism 115. FIG. 6 is a cross-sectional view at the height position indicated by arrows VI in FIG. 5.

(2-2-1) Cylinder Block

The cylinder block 124 is a plate-shaped member in which a cylinder hole 124*a*, an intake hole 124*b*, a discharge channel 124*c*, a bushing accommodation hole 124*d*, and a blade accommodation hole 124*e* are formed. The cylinder hole 124*a* is a column-shaped hole through which the cylinder block 124 passes in a plate thickness direction. The intake hole 124*b* passes through from the external peripheral surface of the cylinder block 124 toward the cylinder hole 124*a*. The discharge channel 124*c* is a space formed by cutting out part of the internal peripheral surface of the cylinder hole 124*a* in the front head 123 side. The bushing accommodation hole 124*d* passes through the cylinder block 124 in the plate thickness direction. The bushing accommodation hole 124*d*, when viewed along the plate thickness direction, is positioned between the intake hole 124*b* and the discharge channel 124*c*. The bushing accommodation hole 124*d* communicates with the cylinder hole 124*a*. The blade accommodation hole 124*e* passes through the cylinder block 124 in the plate thickness direction. The blade accommodation hole 124*e* communicates with the bushing accommodation hole 124*d*.

The cylinder hole 124*a* accommodates an eccentric shaft part 117*a* of the crankshaft 117 and a rotor part 121*a* of the piston 121, as shown in FIG. 6. The bushing accommodation hole 124*d* accommodates a blade part 121*b* of the piston 121 and the bushing 122. The blade accommodation hole 124*e* accommodates the blade part 121*b* of the piston 121.

A cylinder chamber 115*a* is formed in the compression mechanism 115. The cylinder chamber 115*a* is a space enclosed in the front head 123, the cylinder block 124, and the rear head 125. The cylinder chamber 115*a* is partitioned by the piston 121 into an intake chamber communicating with the intake hole 124*b* and a discharge chamber communicating with the discharge channel 124*c*.

(2-2-2) Piston

The piston 121 is configured from the cylindrically shaped rotor part 121*a*, and the blade part 121*b* which protrudes outward in the radial direction of the rotor part 121*a*. The rotor part 121*a* is accommodated in the cylinder hole 124*a* of the cylinder block 124. The rotor part 121*a* is linked to the eccentric shaft part 117*a* of the crankshaft 117. When the crankshaft 117 rotates, the rotor part 121*a* performs an orbiting motion centered about the rotational axis of the crankshaft 117. The blade part 121*b* oscillates while being sandwiched in the bushing 122, and simultaneously performs a reciprocating motion along the longitudinal direction of the blade part 121*b*.

(2-2-3) Bushing

The bushing 122 is a metal member in the shape of a pair of substantially circular columns. While sandwiching the blade part 121*b* of the piston 121, the bushing 122 can oscillate within the bushing accommodation hole 124*d*.

(2-2-4) Front Head

The front head 123 is a member covering the discharge channel 124*c* side of the cylinder block 124. The front head 123 is joined to the internal peripheral surface of the compressor casing 111. The front head 123 has a bearing part 123*a*. The bearing part 123*a* supports the crankshaft 117. The front head 123 has an opening (not shown) for guiding gas refrigerant compressed in the cylinder chamber 115*a* to the space outside of the compression mechanism 115.

(2-2-5) Rear Head

The rear head 125 is a member covering the side of the cylinder block 124 opposite from the discharge channel 124*c*. The rear head 125 has a bearing part 125*a*. The bearing part 125*a* supports the crankshaft 117.

(2-3) Drive Motor

The drive motor 116 is disposed above the compression mechanism 115, and is configured mainly from a stator 151 and a rotor 152. The stator 151 is an annular member fixed to the internal peripheral surface of the compressor casing 111. The rotor 152 is a cylindrical member installed on the inner side of the stator 151 so as to form a slight gap with the internal peripheral surface of the stator 151.

The stator 151 has a plurality of teeth (not shown) that protrude inward from the internal peripheral surface of the stator. A copper wire is wound over the teeth to form a coil. Coil ends 153 are formed at the upper and lower end parts of the stator 151. In the external peripheral surface of the stator 151 are formed core cuts (not shown), which are grooves formed from the upper end of the stator 151 toward the lower end, and which are disposed at fixed intervals in a circumferential direction.

The rotor 152 is linked to the crankshaft 117. When the crankshaft 117 rotates, the rotor 152 can rotate about the rotational axis of the crankshaft 117.

(2-4) Crankshaft

The crankshaft 117 has the eccentric shaft part 117*a*, which is provided at the vertically lower end in as shown in FIG. 5. The crankshaft 117 is linked to the drive motor 116 at the vertically upper end.

(2-5) Intake Tube

The intake tube 119 is a tube attached passing through a side wall part of the compressor casing 111. One end of the intake tube 119 is fitted into the intake hole 124*b* of the cylinder block 124. The other end of the intake tube 119 is linked to the outlet tube 13 of the accumulator 11.

(2-6) Discharge Tube

The discharge tube 120 is a tube attached passing through an upper wall part of the compressor casing 111. One end of the discharge tube 120 is positioned above the drive motor 116 in the internal space of the compressor casing 111. The other end of the discharge tube 120 is connected to a pipe (not shown) of the refrigerant circuit.

(3) Characteristics of Accumulator

In the internal space 12*a* of the accumulator 11, gas-liquid two-phase refrigerant is separated into gas refrigerant and liquid refrigerant. First, the gas-liquid two-phase refrigerant flows through the interior of the inlet tube 14 and into the internal space 12*a*. Next, the gas-liquid two-phase refrigerant then passes through the filter 15, and impurities contaminating the refrigerant are removed. Next, the gas-liquid two-phase refrigerant collides with the baffle 17. The liquid refrigerant contained in the gas-liquid two-phase refrigerant thereby adheres to the surface of the baffle 17. The liquid refrigerant adhering to the baffle 17 flows over the surface of the baffle 17 toward the outer edge, and falls through the internal space 12*a* to accumulate below the accumulator 11. Meanwhile, the gas refrigerant contained in the gas-liquid two-phase refrigerant flows from the internal space 12*a* into the outlet tube 13. The gas refrigerant flows through the interior of the outlet tube 13 and into the intake tube 119 of the compressor 101.

The gas refrigerant separated in the accumulator 11 is drawn into the compressor 101. In the compression mechanism 115 of the compressor 101, the gas refrigerant is periodically drawn into the cylinder chamber 115*a* in synchronization with the orbiting motion of the piston 121. Therefore, the step of gas refrigerant intake by the compressor 101 causes the pressure of the gas refrigerant to fluctuate in the internal space 12*a* of the accumulator 11. Specifically, the pressure in the internal space 12*a* decreases while the compressor 101 is drawing in gas refrigerant, and pressure in the internal space 12*a* increases while the compressor 101 is compressing gas refrigerant. In other words, pressure fluctuation in the gas refrigerant is a periodic change in the pressure in the internal space 12*a*.

Figure 7:
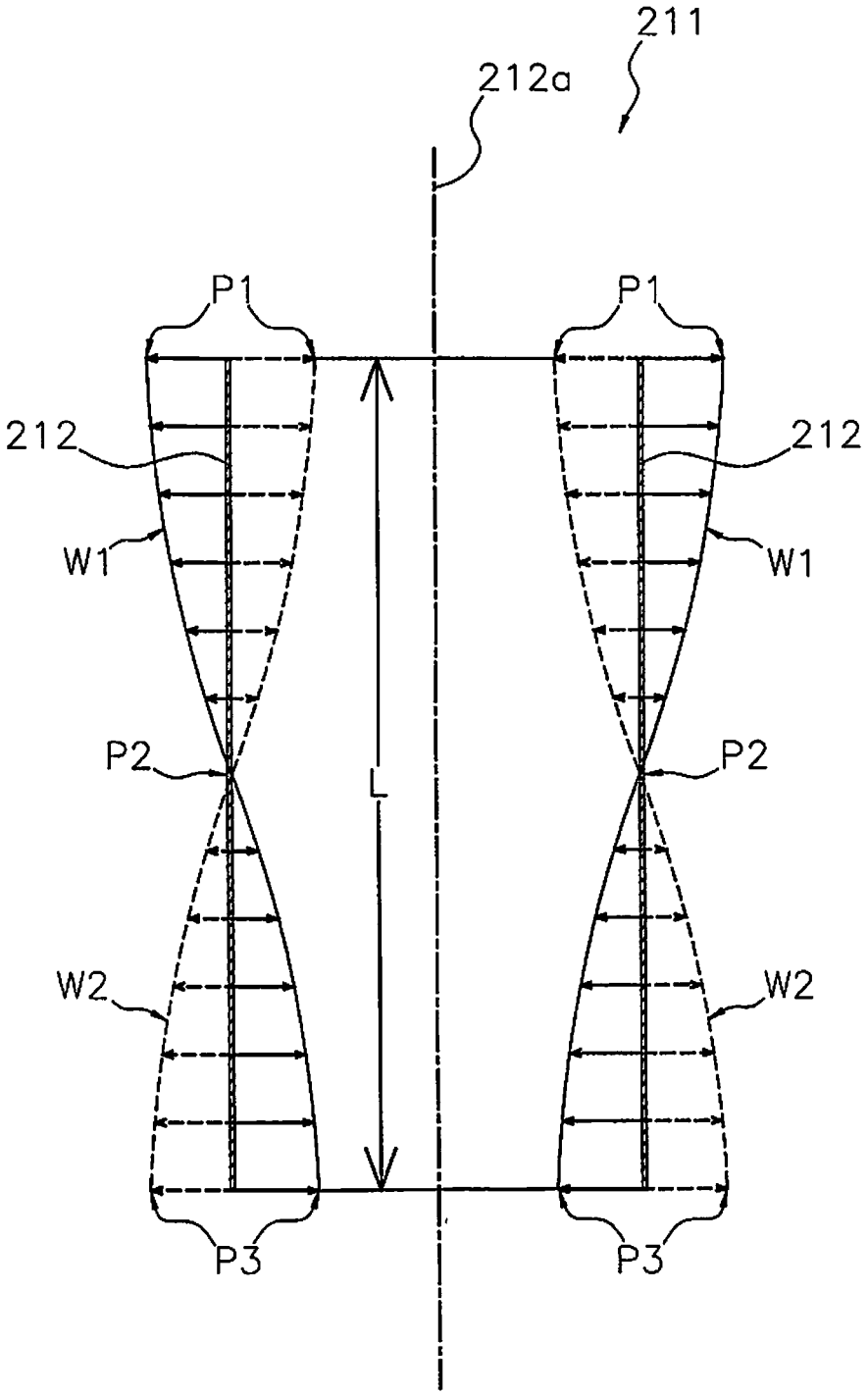
(PRIOR ART) FIG. 7
FIG. 7 is a longitudinal cross-sectional schematic view of an accumulator, serving as a comparative example, that does not have resonance-suppressing members.

FIG. 7 is a longitudinal cross-sectional schematic view of an accumulator 211, serving as a comparative example, which does not have the resonance-suppressing members 18, 19. In FIG. 7, a casing 212 of the accumulator 211 is schematically shown to have a cylindrical shape. FIG. 7 shows a cylinder axis 212*a* that links the center of the upper surface and the center of the lower surface of this cylinder. The cylinder axis 212*a* is parallel to the vertical direction. Hereinafter, the vertical dimension of the casing 212 is referred to as L.

In the internal space of the casing 212 of the accumulator 211, the pressure fluctuation in the gas refrigerant causes a standing wave in the vertical direction. The basic frequency of the standing wave is the frequency for a wavelength of 2L. The basic frequency of the standing wave, though also dependent on the vertical dimension L of the casing 212, is 400 Hz to 900 Hz. In FIG. 7, a first wave W1 and a second wave W2, which occur when the standing wave amplitude is at a maximum, are shown respectively by solid lines and dashed lines. The arrows shown in FIG. 7 represent the distribution of the load of the gas refrigerant acting on the casing 212. The solid-line arrows represent the distribution of the pressure of gas refrigerant acting on the casing 212 when the first wave W1 is being generated. The dashed-line arrows represent the distribution of the pressure of gas refrigerant acting on the casing 212 when the second wave W2 is being generated. The first wave W1 and the second wave W2 are generated alternatingly in the internal space of the casing 212 at the basic frequency of the standing wave. In a horizontal cross section of the accumulator 211, the pressure distribution would be symmetric about the cylinder axis 212*a*.

The first wave W1 and the second wave W2 have, from the upper end of the casing 212 toward the lower end, a first antinode P1, a node P2, and a second antinode P3. The first antinode P1 and the second antinode P3 are respectively in the height positions of the upper and lower ends of the casing 212, which are the height positions where the pressure fluctuation reaches a maximum. The node P2 is in the height position of the vertical center of the casing 212, which is the height position where the pressure fluctuation reaches zero.

In the accumulator 211 serving as a comparative example, the standing wave described above resonates with the casing 212, whereby the casing 212 vibrates in the direction of the arrows shown in FIG. 7. As a result, the casing 212 emits noise.

On the other hand, in the accumulator 11 according to the present embodiment, the upper resonance-suppressing member 18 and the lower resonance-suppressing member 19 are attached at height positions near to, respectively, the upper end and lower end of the cylinder portion 22 of the casing 12. In the accumulator 211 serving as a comparative example, the height positions near to the upper end and lower end of the casing 212 are height positions where, respectively, the first antinode P1 and the second antinode P3 of the standing wave are present, and where pressure fluctuation reaches a maximum. In other words, in the present embodiment, the upper resonance-suppressing member 18 and the lower resonance-suppressing member 19 are attached at height positions near to the height positions where pressure fluctuation reaches a maximum in the internal space 12*a*.

The upper resonance-suppressing member 18 and the lower resonance-suppressing member 19 have the effect of hindering pressure fluctuation. Therefore, by attaching the upper resonance-suppressing member 18 and the lower resonance-suppressing member 19 at height positions where pressure fluctuation reaches a maximum, i.e., height positions near to the upper end and lower end of the casing 12 within the internal space 12*a* of the accumulator 11, it is possible to reduce the maximum value of the pressure fluctuation amplitude and to eliminate resonance caused by pressure fluctuation. As a result, the vibration of the casing 12 of the accumulator 11 is minimized, and noise emitted from the accumulator 11 during operation is reduced.

(4) Examples

There follows a description of the results of using a simulation to analyze the effect by which the upper resonance-suppressing member 18 and the lower resonance-suppressing member 19 hinder pressure fluctuation. The simulation analysis results were used to examine the range of height positions for the upper resonance-suppressing member 18 and the lower resonance-suppressing member 19 at which the effect of hindering pressure fluctuation occurred. Specifically, calculations were made of pressure fluctuation in internal spaces of an imaginary first casing 91 and second casing 92, which had cylindrical shapes. The first casing 91 was envisioned as a casing of an accumulator attached to a large swing-type compressor. The second casing 92 was envisioned as a casing of an accumulator attached to a small swing-type compressor. Imaginary resonance-suppressing members, equivalent to the upper resonance-suppressing member 18 and the lower resonance-suppressing member 19, were attached in the internal spaces of the first casing 91 and the second casing 92, respectively.

Figure 8:
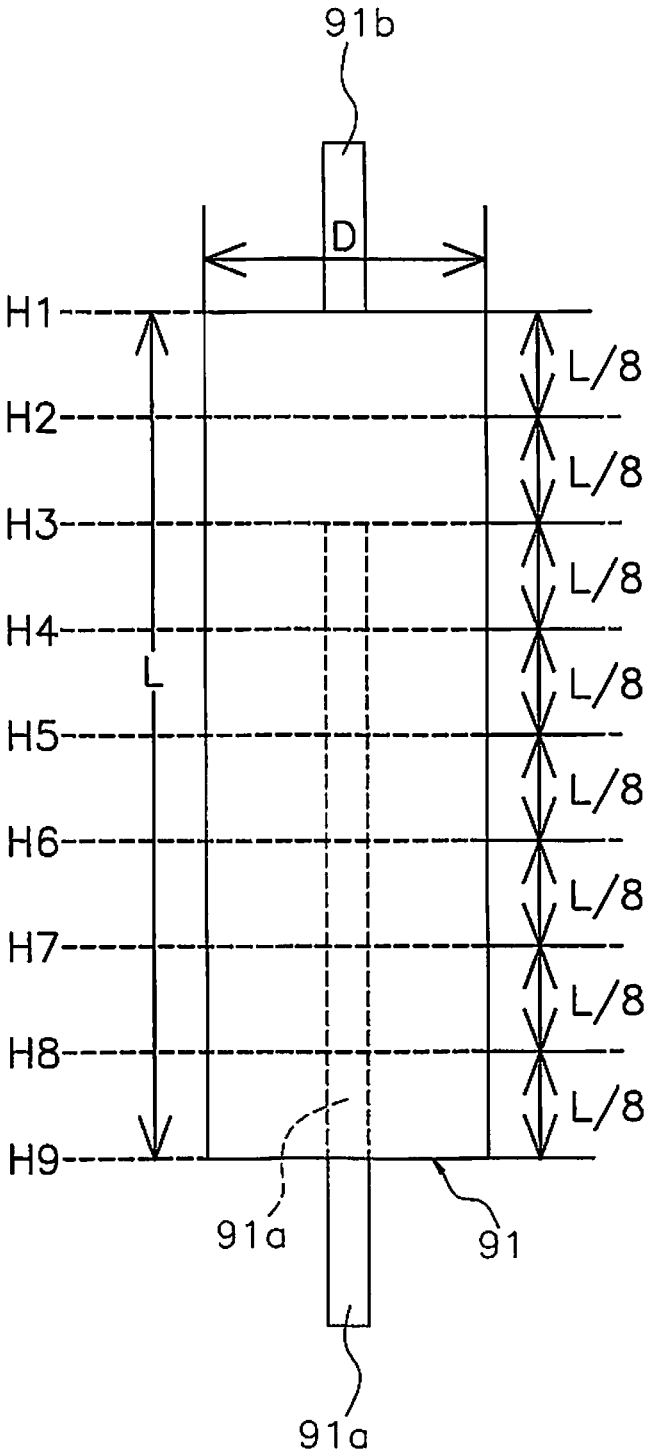
FIG. 8 shows the shape and dimension of a first casing, and position of a resonance-suppressing member, according to an example.
Figure 9:
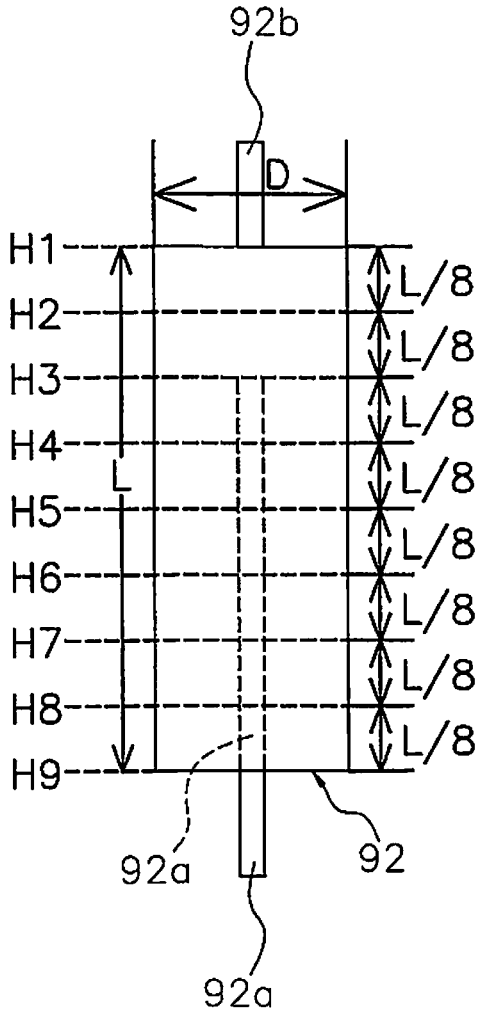
FIG. 9 shows the shape and dimension of a second casing, and position of a resonance-suppressing member, according to an example.

FIG. 8 is a schematic diagram of the first casing 91. FIG. 9 is a schematic diagram of the second casing 92. The rotational axes of the cylindrical shapes of the first casing 91 and second casing 92 run along the vertical direction. The vertical dimension L of the first casing 91 is 210.8 mm. The diameter D of the first casing 91 is 71.0 mm. The vertical dimension L of the second casing 92 is 129.0 mm. The diameter D of the second casing 92 is 47.8 mm.

The first casing 91 has an outlet tube 91*a* and an inlet tube 91*b*. The second casing 92 has an outlet tube 92*a* and an inlet tube 92*b*. The outlet tubes 91*a*, 92*a* are equivalent to the outlet tube 13 of the embodiment. The inlet tubes 91*b*, 92*b* are equivalent to the inlet tube 14 of the embodiment. The outlet tubes 91*a*, 92*a* pass through lower end surfaces of the casings 91, 92, respectively. End parts of the outlet tubes 91*a*, 92*a* are positioned in the internal spaces of the casings 91, 92, respectively. End parts of the inlet tubes 91*b*, 92*b* are at the same height positions as upper end surfaces of the casings 91, 92, respectively.

Height positions H1 to H9 in nine locations are defined as shown in FIGS. 8 and 9. H1 to H9 are disposed at equal intervals in the vertical direction. H1 is height position level with the upper ends of the casings 91, 92. H2 is a height position at a distance of L/8 from the upper ends of the casings 91, 92 toward the lower ends. H3 is a height position at a distance of L/4 from the upper ends of the casings 91, 92 toward the lower ends. H4 is a height position at a distance of 3L/8 from the upper ends of the casings 91, 92 toward the lower ends. H5 is a height position in the middle between the upper and lower ends of the casings 91, 92. H6 is a height position at a distance of 3L/8 from the lower ends of the casings 91, 92 toward the upper ends. H7 is a height position at a distance of L/4 from the lower ends of the casings 91, 92 toward the upper ends. H8 is a height position at a distance of L/8 from the lower ends of the casings 91, 92 toward the upper ends. H9 is a height position level with the lower ends of the casings 91, 92. The height position of the end parts of the outlet tubes 91*a*, 92*a* in the internal spaces of the casings 91, 92 is H3.

Patterns of attachment positions for the imaginary resonance-suppressing members are configured from five patterns PT1 to PT5. With pattern PT1, a resonance-suppressing member is attached only at H5. With pattern PT2, resonance-suppressing members are attached at H4 and H6. With pattern PT3, resonance-suppressing members are attached at H3 and H7. With pattern PT4, resonance-suppressing members are attached at H2 and H8. With pattern PT5, resonance-suppressing members are attached at height positions where they will be near to H1 and H9 and will not make contact with the casings 91, 92. With pattern PT5, the gaps between the end surfaces of the casings 91, 92 and the resonance-suppressing members are 1 mm.

Figure 10:
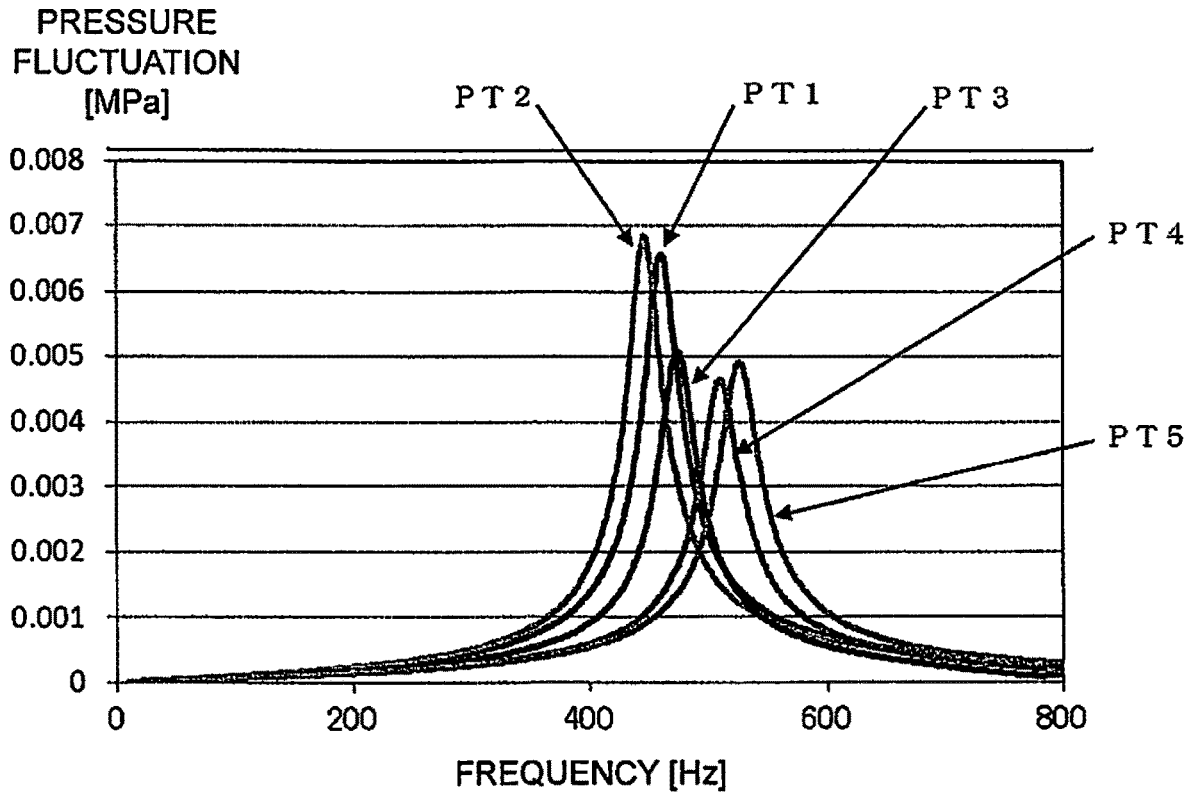
FIG. 10 shows analysis results for the first casing at a height position H1.
Figure 11:
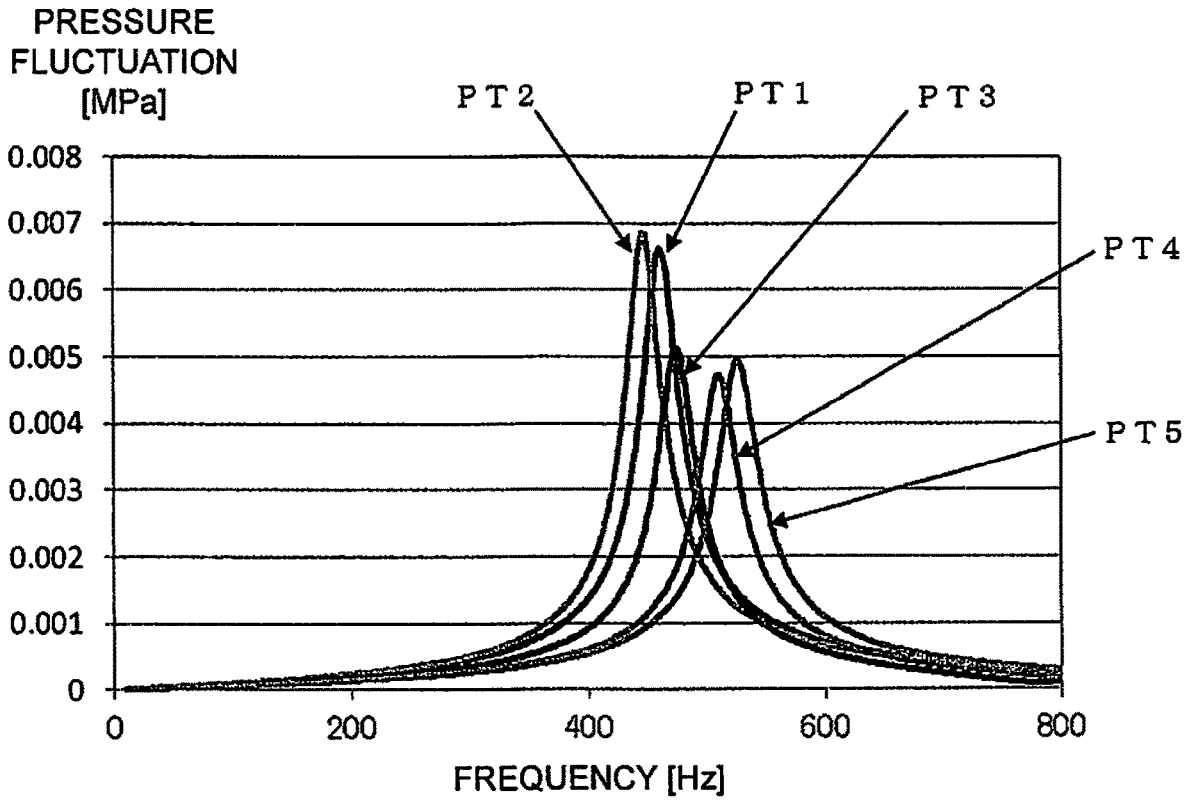
FIG. 11 shows analysis results for the first casing at a height position H9.
Figure 12:
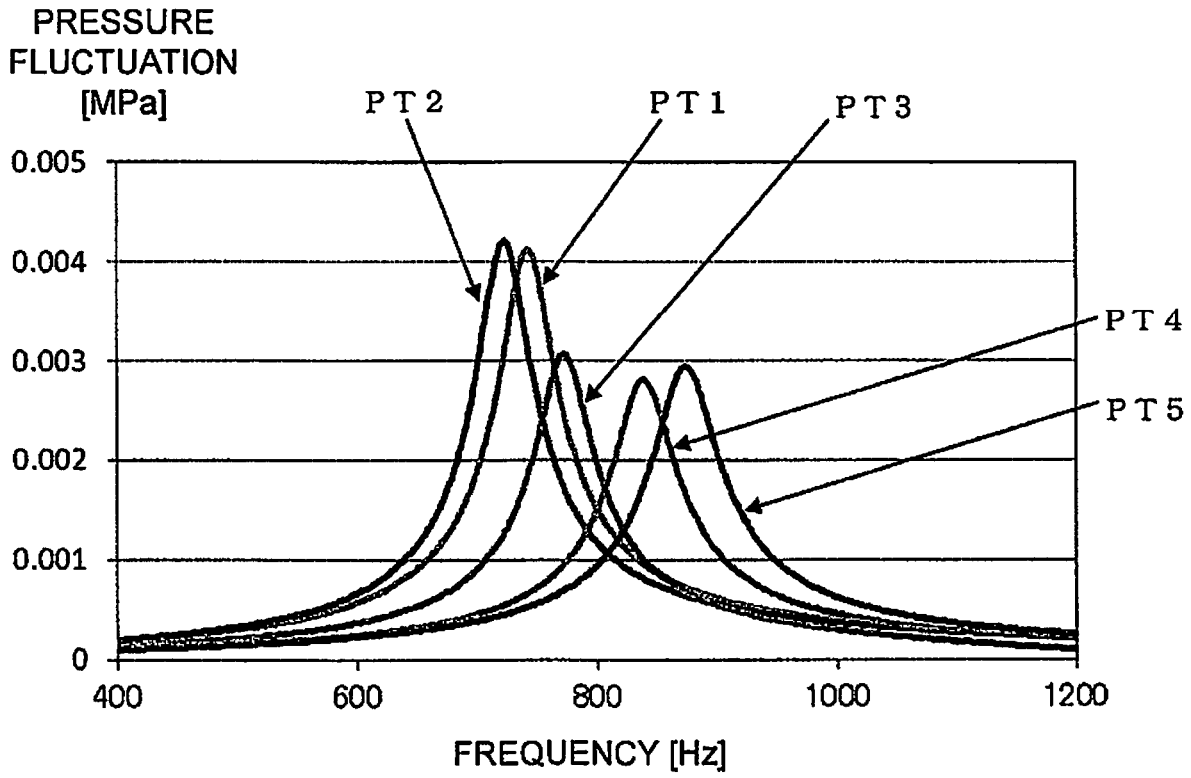
FIG. 12 shows analysis results for the second casing at a height position H1.
Figure 13:
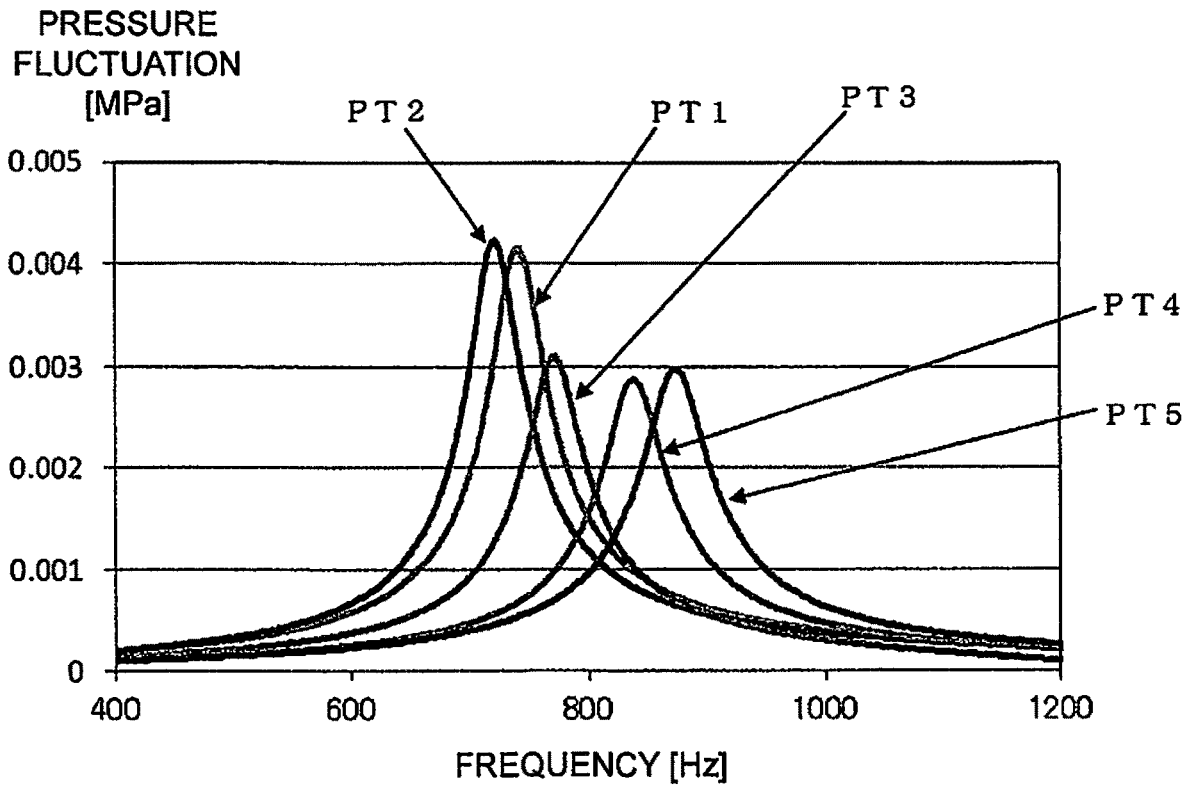
FIG. 13 shows analysis results for the second casing at a height position H9.

FIGS. 10 and 11 show the analysis results for the first casing 91. FIGS. 12 and 13 show the analysis results for the second casing 92. FIGS. 10 and 12 show the analysis results of pressure fluctuation at the height position H1. FIGS. 11 and 13 show the analysis results of pressure fluctuation at the height position H9. In FIGS. 10 to 13, the horizontal axes represent the frequencies (Hz) of the standing waves generated in the internal spaces of the casings 91, 92, and the vertical axes represent the sizes (MPa) of the standing waves generated in the internal spaces of the casings 91, 92.

At frequencies of 400 Hz to 900 Hz, the maximum values of pressure fluctuation in patterns PT3 to PT5 are lower than the maximum values of pressure fluctuation in patterns PT1 and PT2, as shown in FIGS. 10 to 13. In other words, with patterns PT3 to PT5, the effect of pressure fluctuation being hindered by the resonance-suppressing members was confirmed. It was also confirmed that this effect is independent of the height and diameter of the casings 91, 92. Therefore, it was confirmed through simulation that pressure fluctuation in the internal spaces of the casings 91, 92 is hindered by attaching the resonance-suppressing members to the casings 91, 92 so that the height positions of the resonance-suppressing members are in the ranges of H1 to H3 and H7 to H9.

(5) Modifications (5-1) Modification A

The accumulator 11 according to the present embodiment is provided with two resonance-suppressing members 18, 19. The upper resonance-suppressing member 18 and the lower resonance-suppressing member 19 are respectively attached to height positions near to the upper end and lower end of the cylinder portion 22 of the casing 12.

However, another option is for the accumulator 11 to be provided with only the upper resonance-suppressing member 18 or only the lower resonance-suppressing member 19. In this case as well, the upper resonance-suppressing member 18 or the lower resonance-suppressing member 19 hinders pressure fluctuation in the internal space 12*a*, and resonance caused by pressure fluctuation can be eliminated. As a result, noise emitted from the accumulator 11 during operation is reduced.

Figure 14:
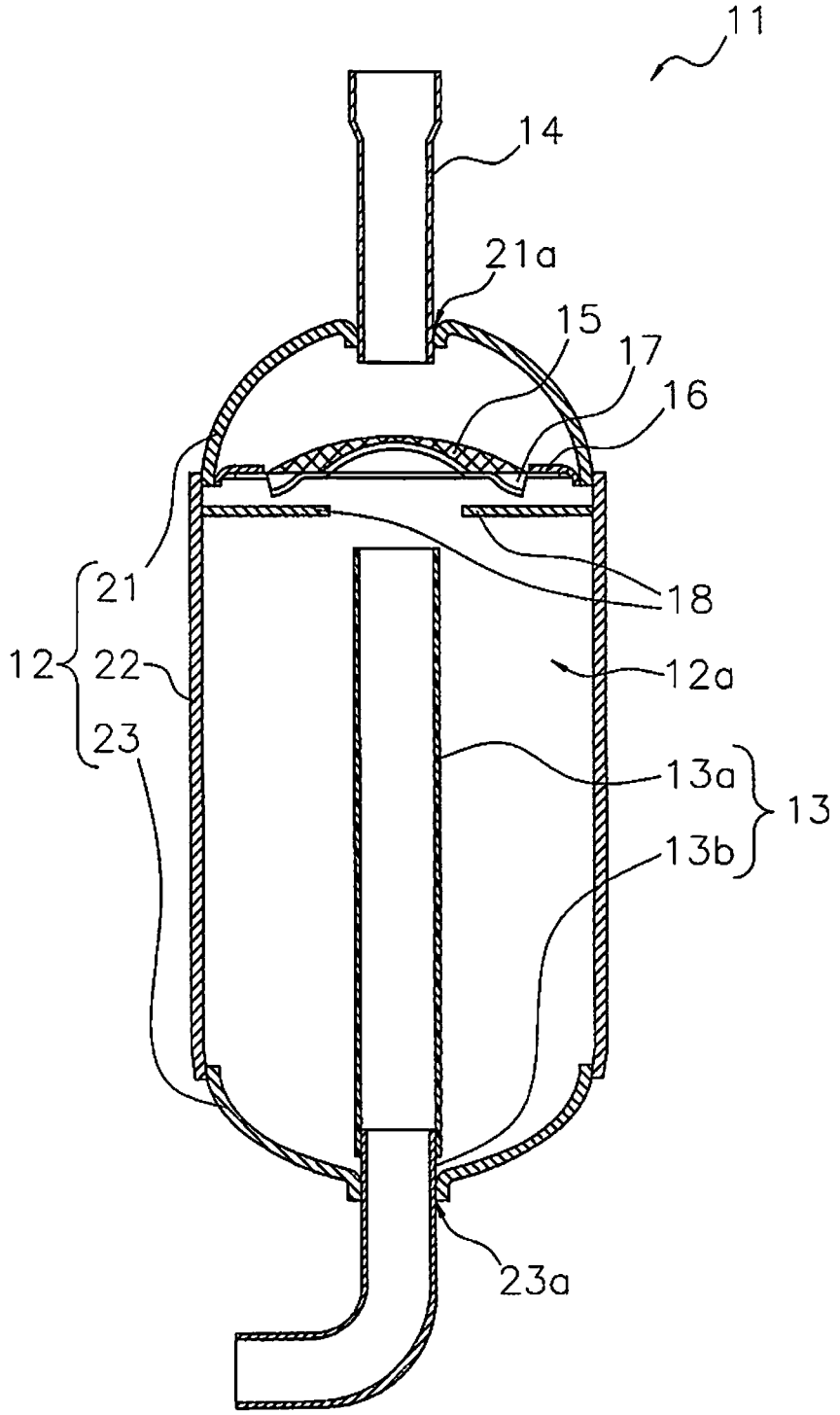
FIG. 14 is a longitudinal cross-sectional view of an accumulator according to Modification A.
Figure 15:
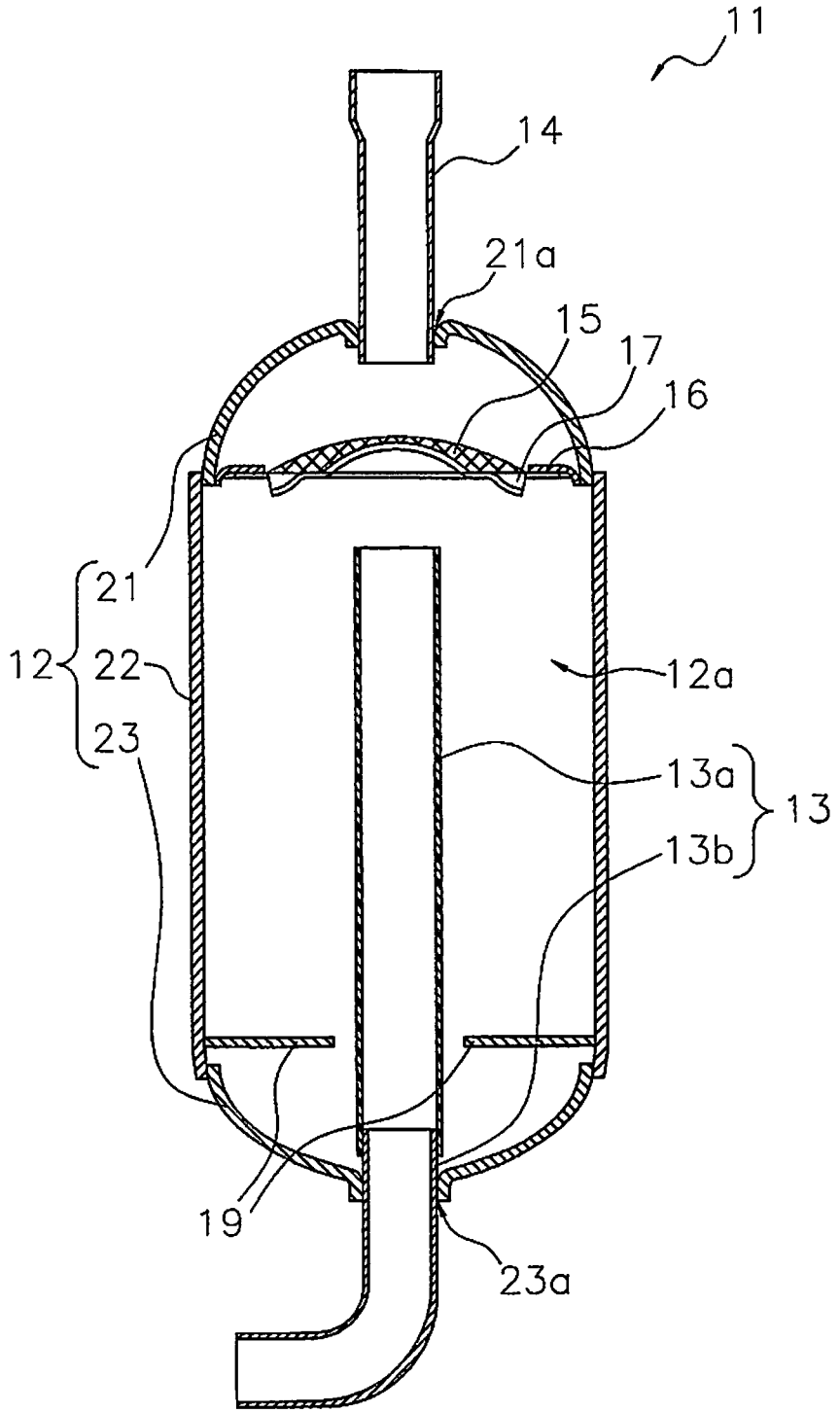
FIG. 15 is a longitudinal cross-sectional view of an accumulator according to Modification A.

FIGS. 14 and 15 are longitudinal cross-sectional views of the accumulator 11 according to the present modification. The accumulator 11 shown in FIG. 14 has a configuration in which the lower resonance-suppressing member 19 has been taken out of the accumulator 11 of the embodiment. The accumulator 11 shown in FIG. 15 has a configuration in which the upper resonance-suppressing member 18 has been taken out of the accumulator 11 of the embodiment.

(5-2) Modification B

The accumulator 11 according to the present embodiment is provided with the annular resonance-suppressing members 18, 19 shown in FIGS. 2 and 3. The external peripheral surfaces of the resonance-suppressing members 18, 19 are joined in their entirety to the internal peripheral surfaces of the cylinder portion 22 of the casing 12.

Figure 16:
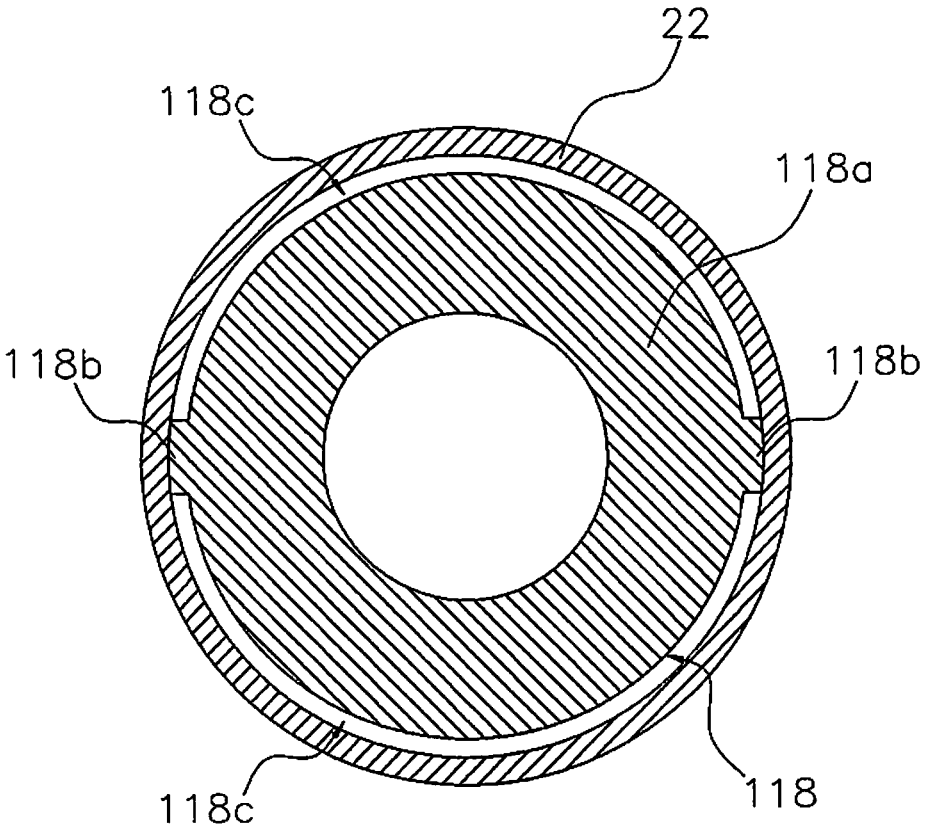
FIG. 16 shows a resonance-suppressing member according to Modification B.

However, as long as the resonance-suppressing members 18, 19 have annular portions, they may be members that have another shape. FIG. 16, which is a cross-sectional view similar to FIG. 2, shows an example of a resonance-suppressing member 118 of the present modification. The resonance-suppressing member 118 has an annular portion 118*a*, and two protruding parts 118*b* that protrude from the external peripheral surface of the annular portion 118*a*. The two protruding parts 118*b* are disposed so as to oppose each other about the center of the annular portion 118*a*. The two protruding parts 118*b* are joined to the internal peripheral surface of the cylinder portion 22 of the casing 12, whereby the resonance-suppressing member 118 is secured to the casing 12. In this case, gaps 118*c* are formed between the annular portion 118*a* and the cylinder portion 22. Liquid refrigerant colliding with the baffle 17 can fall through the gaps 118*c*.

In the present modification, the resonance-suppressing member 118 is attached in at least one of the height positions where the resonance-suppressing members 18, 19 are installed in the embodiment. The resonance-suppressing member 118 may also have any desired number of protruding parts 118*b*.

(5-3) Modification C

The compressor 101 connected with the accumulator 11 of the present embodiment is a single-cylinder compressor as shown in FIG. 5. However, the compressor 101 may also be a dual-cylinder compressor.

Figure 17:
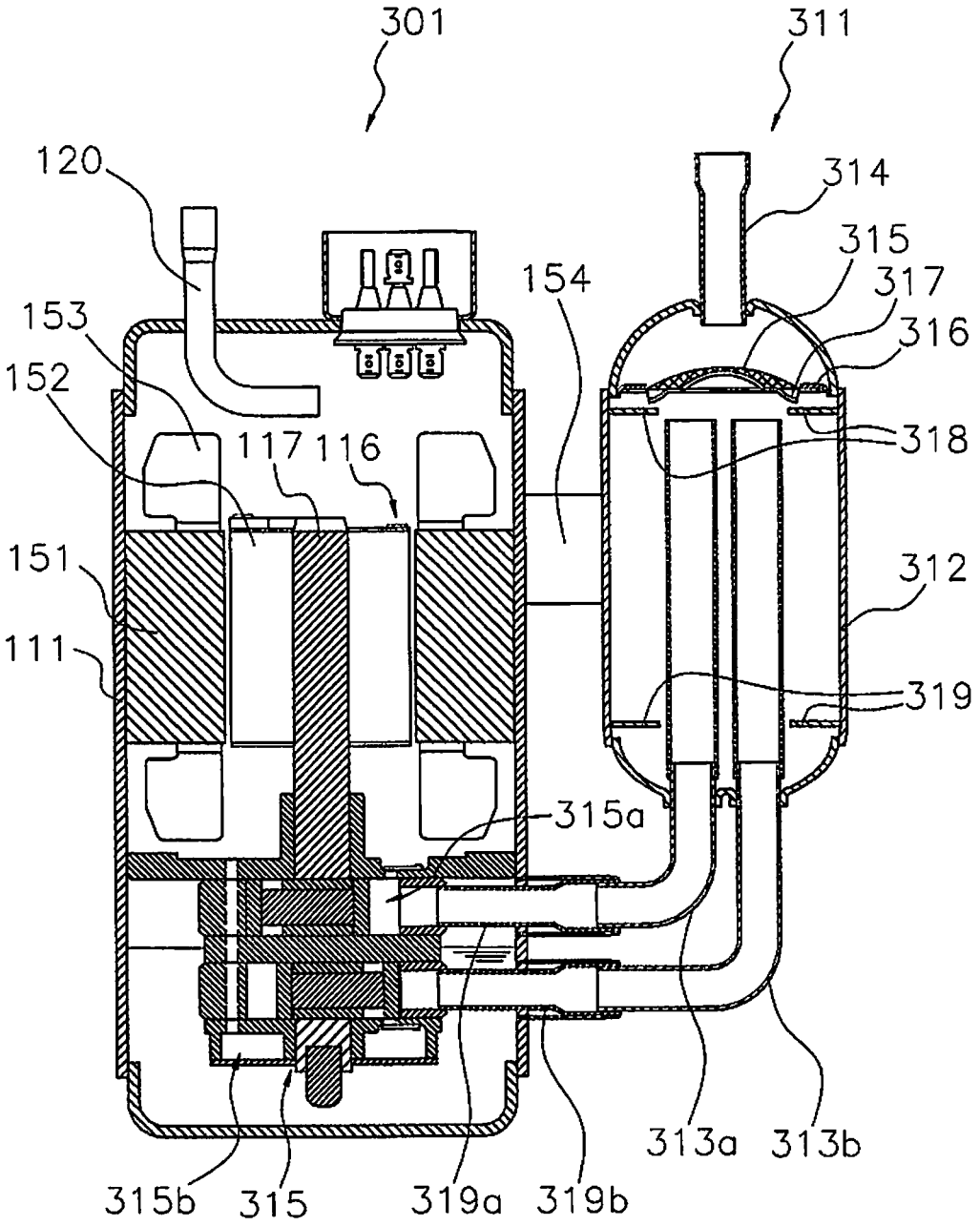
FIG. 17 is a longitudinal cross-sectional view of a compressor to which an accumulator is connected, according to Modification C.

FIG. 17 is a longitudinal cross-sectional view of a compressor 301 to which an accumulator 311 in the present modification is connected. In FIG. 17, configurative elements identical to those in FIG. 5 are denoted by the same reference symbols. The compressor 301 is a dual-cylinder swing compressor. The compressor 301 is provided with a compression mechanism 315 and two intake tubes 319*a*, 319*b*. The compression mechanism 315 has two cylinder chambers 315*a*, 315*b*. In the compression mechanism 315, refrigerant drawn in from the upper intake tube 319*a* is compressed in the upper cylinder chamber 315*a*, and refrigerant drawn in from the lower intake tube 319*b* is compressed in the lower cylinder chamber 315*b*.

The accumulator 311 is mainly provided with a casing 312, two outlet tubes 313*a*, 313*b*, an inlet tube 314, a filter 315, a holder 316, a baffle 317, and two resonance-suppressing members 318, 319. The inlet tube 314, the filter 315, the holder 316, and the baffle 317 are respectively identical to the inlet tube 14, the filter 15, the holder 16, and the baffle 17 of the embodiment. The two outlet tubes 313*a*, 313*b* are passed through and fixed to a bottom surface of the casing 312. The outlet tube 313*a* is linked to the inlet tube 319*a* of the compression mechanism 315. The outlet tube 313*b* is linked to the inlet tube 319*b* of the compression mechanism 315. The resonance-suppressing members 318, 319, which respectively have the same shapes as the resonance-suppressing members 18, 19 of the embodiment, are attached to the same height positions.

In the present modification, the accumulator 311 may also be provided to only one of the two resonance-suppressing members 318, 319.

(5-4) Modification D

The resonance-suppressing members 18, 19 of the accumulator 11 according to the present embodiment are annular members in which a single circular hole is formed in the middle, as shown in FIGS. 2 and 3. However, the resonance-suppressing members 18, 19 may each have a hole in the shape of something other than a circle, or they may each have two or more holes. Next, modifications of the resonance-suppressing members 18, 19 are described with reference to FIGS. 18 to 22.

Figure 18:
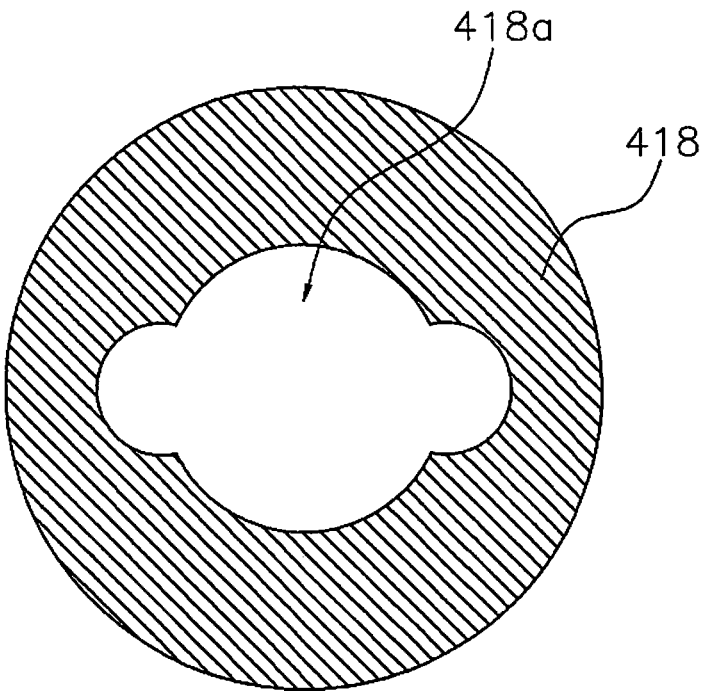
FIG. 18 is an example of a plan view of an upper resonance-suppressing member according to Modification D.

FIG. 18 is a plan view of an upper resonance-suppressing member 418, which is one modification of the upper resonance-suppressing member 18. The upper resonance-suppressing member 418 can use the accumulator 11 connected to the single-cylinder compressor 101 shown in FIG. 5, and the accumulator 311 connected to the dual-cylinder compressor 301 shown in FIG. 17. The upper resonance-suppressing member 418 has a communication hole 418*a* in the middle. The communication hole 418*a* has the shape of something other than a circle. The configuration shown in FIG. 18 can also be applied to the lower resonance-suppressing member 19.

Figure 19:
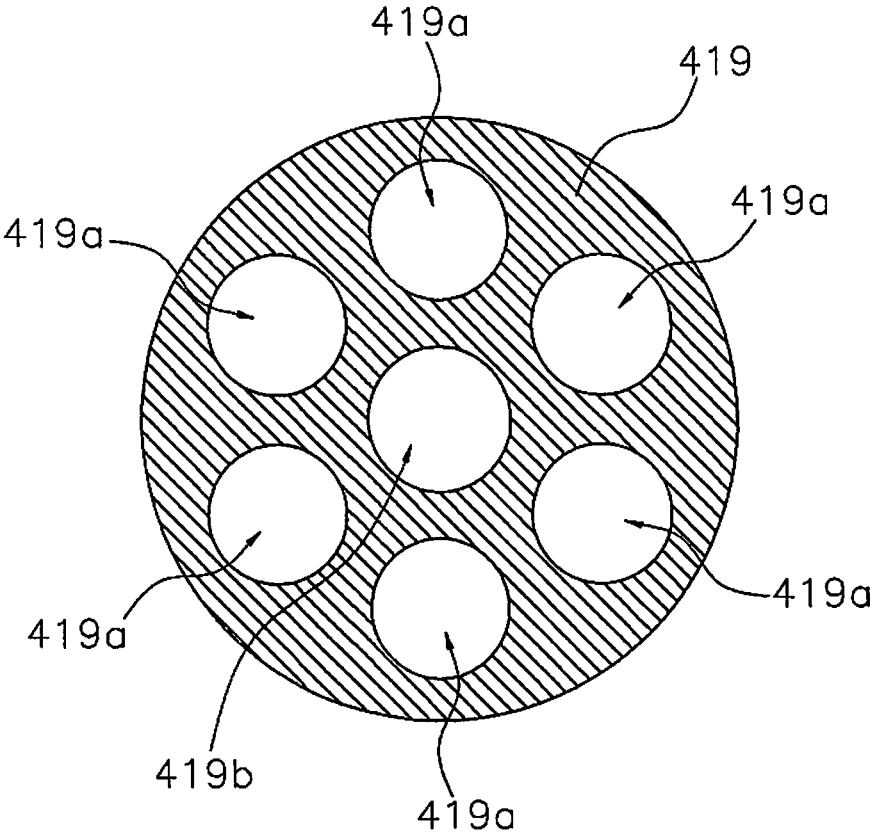
FIG. 19 is an example of a plan view of a lower resonance-suppressing member according to Modification D.

FIG. 19 is a plan view of a lower resonance-suppressing member 419, which is one modification of the lower resonance-suppressing member 19. The lower resonance-suppressing member 419 can be used in the accumulator 11 connected to the single-cylinder compressor 101 shown in FIG. 5. The lower resonance-suppressing member 419 has one tube passage hole 419*b* and six communication holes 419*a*. The tube passage hole 419*b* is formed in the middle of the lower resonance-suppressing member 419, and is a circular hole through which the outlet tube 13*a* passes. The diameter of the tube passage hole 419*b* is equal to the outside diameter of the outlet tube 13*a*. The communication holes 419*a* are circular holes formed around the periphery of the tube passage hole 419*b*, in six-fold symmetry about the center of the lower resonance-suppressing member 419. The shapes of the communication holes 419*a* are not limited to circles. The outlet tube 13*a* may be attached to the lower resonance-suppressing member 419 by brazing, etc. in the position where the outlet tube passes through the tube passage hole 419*b*. The attachment tolerance of the outlet tube 13*a* can be reduced by attaching the outlet tube 13*a* to the lower resonance-suppressing member 419.

Figure 20:
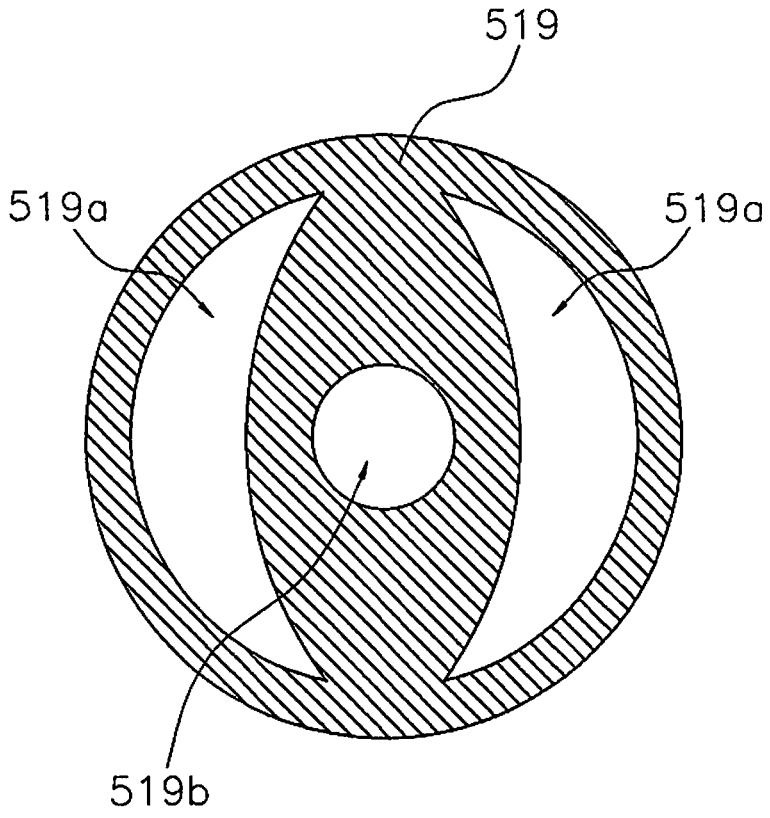
FIG. 20 is an example of a plan view of a lower resonance-suppressing member according to Modification D.

FIG. 20 is a plan view of a lower resonance-suppressing member 519, which is one modification of the lower resonance-suppressing member 19. The lower resonance-suppressing member 519 can be used in the accumulator 11 connected to the single-cylinder compressor 101 shown in FIG. 5. The lower resonance-suppressing member 519 has one tube passage hole 519*b* and two communication holes 519*a*. The tube passage hole 519*b* is formed in the middle of the lower resonance-suppressing member 519, and is a circular hole through which the outlet tube 13*a* passes. The diameter of the tube passage hole 519*b* is equal to the outside diameter of the outlet tube 13*a*. The communication holes 519*a* are fan-shaped holes formed around the periphery of the tube passage hole 519*b*, in two-fold symmetry about the center of the lower resonance-suppressing member 519. The shapes of the communication holes 519*a* are not limited to fans. The outlet tube 13*a* may be attached to the lower resonance-suppressing member 519 by brazing, etc. in the position where the outlet tube passes through the tube passage hole 519*b*. The attachment tolerance of the outlet tube 13*a* can be reduced by attaching the outlet tube 13*a* to the lower resonance-suppressing member 519.

Figure 21:
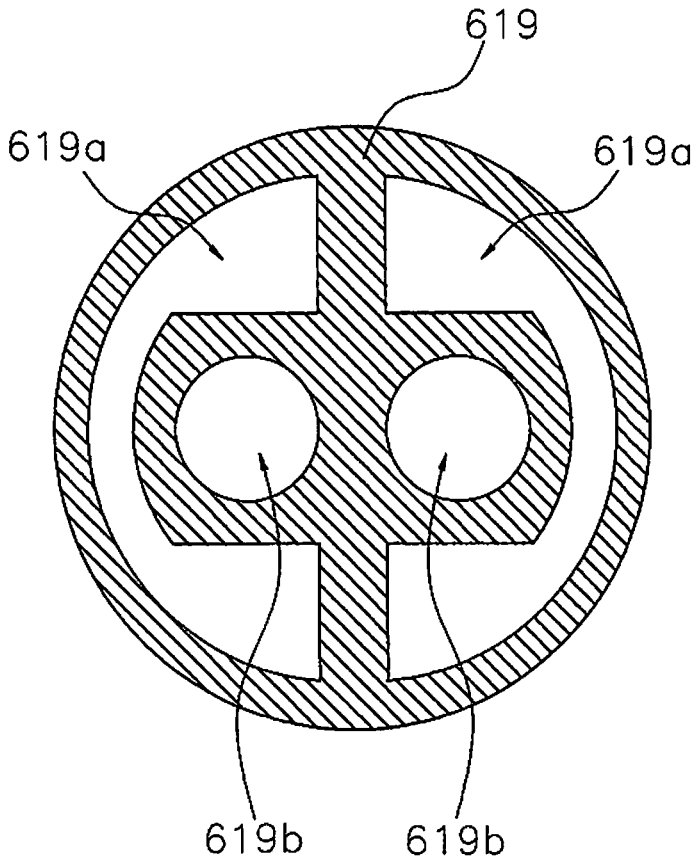
FIG. 21 is an example of a plan view of a lower resonance-suppressing member according to Modification D.

FIG. 21 is a plan view of a lower resonance-suppressing member 619, which is one modification of the resonance-suppressing member 319 of Modification C. The lower resonance-suppressing member 619 can be used in the accumulator 311 connected to the dual-cylinder compressor 301 shown in FIG. 17. The lower resonance-suppressing member 619 has two tube passage holes 619*b* and two communication holes 619*a*. The two tube passage holes 619*b* are formed in the middle of the lower resonance-suppressing member 619, and are circular holes through which the outlet tubes 313*a*, 313*b* pass. The diameters of the tube passage holes 619*b* are equal to the outside diameters of the outlet tubes 313*a*, 313*b*. The communication holes 619*a* are arch-shaped holes formed around the periphery of the tube passage holes 619*b*, in two-fold symmetry about the center of the lower resonance-suppressing member 619. The shapes of the communication holes 619*a* are not limited to arch shapes. The outlet tubes 313*a*, 313*b* may be attached to the lower resonance-suppressing member 619 by brazing, etc. in the positions where the outlet tubes pass through the tube passage holes 619*b*. The attachment tolerance of the outlet tubes 313*a*, 313*b* can be reduced by attaching the outlet tubes 313*a*, 313*b* to the lower resonance-suppressing member 619.

Figure 22:
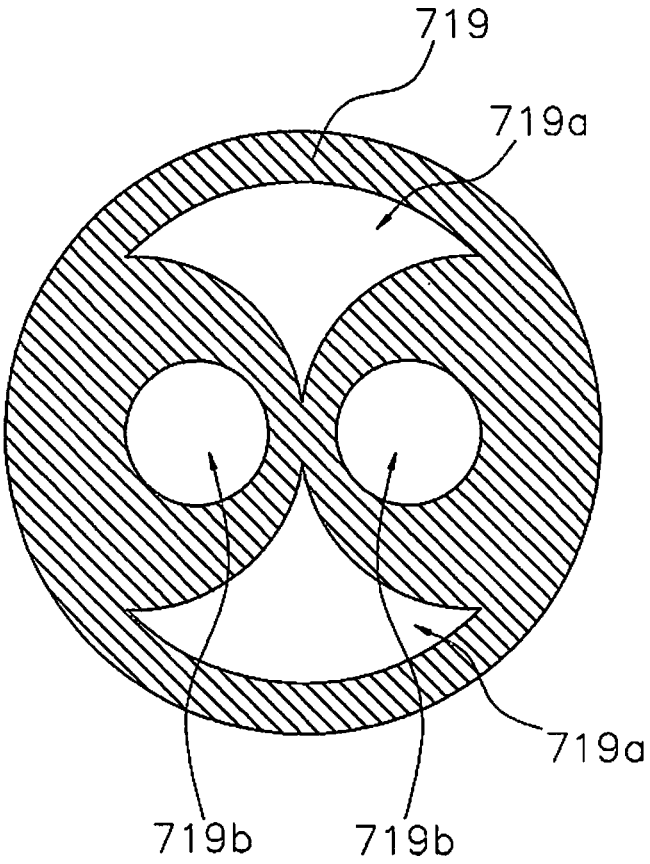
FIG. 22 is an example of a plan view of a lower resonance-suppressing member according to Modification D.

FIG. 22 is a plan view of a lower resonance-suppressing member 719, which is one modification of the lower resonance-suppressing member 319 of Modification C. The lower resonance-suppressing member 719 can be used in the accumulator 311 connected to the dual-cylinder compressor 301 shown in FIG. 17. The lower resonance-suppressing member 719 has two tube passage holes 719*b* and two communication holes 719*a*. The two tube passage holes 719*b* are formed in the middle of the lower resonance-suppressing member 719, and are circular holes through which the outlet tubes 313*a*, 313*b* pass. The diameters of the tube passage holes 719*b* are equal to the outside diameters of the outlet tubes 313*a*, 313*b*. The communication holes 719*a* are fan-shaped holes formed around the periphery of the tube passage holes 719*b*, in two-fold symmetry about the center of the lower resonance-suppressing member 719. The shapes of the communication holes 719*a* are not limited to fan shapes. The outlet tubes 313*a*, 313*b* may be attached to the lower resonance-suppressing member 719 by brazing, etc. in the positions where the outlet tubes pass through the tube passage holes 719*b*. The attachment tolerance of the outlet tubes 313*a*, 313*b* can be reduced by attaching the outlet tubes 313*a*, 313*b* to the lower resonance-suppressing member 719.

FIGS. 18 to 22 merely depict the present modification; the shapes, positions, and number of holes formed in the resonance-suppressing members shown in FIGS. 18 to 22 are not limited to those in the modification shown in FIGS. 18 to 22. The present modification can also be applied to Modifications A and B.

(5-5) Modification E

The resonance-suppressing members 18, 19 of the accumulator 11 according the present embodiment are thin sheets made of metal. The resonance-suppressing members 18, 19 are annular members attached respectively to the upper portion and lower portion of the casing 12, as shown in FIGS. 1 to 3. However, the resonance-suppressing members 18, 19 may have surfaces that make contact with the internal peripheral surface of the casing 12, as is described below.

Figure 23:
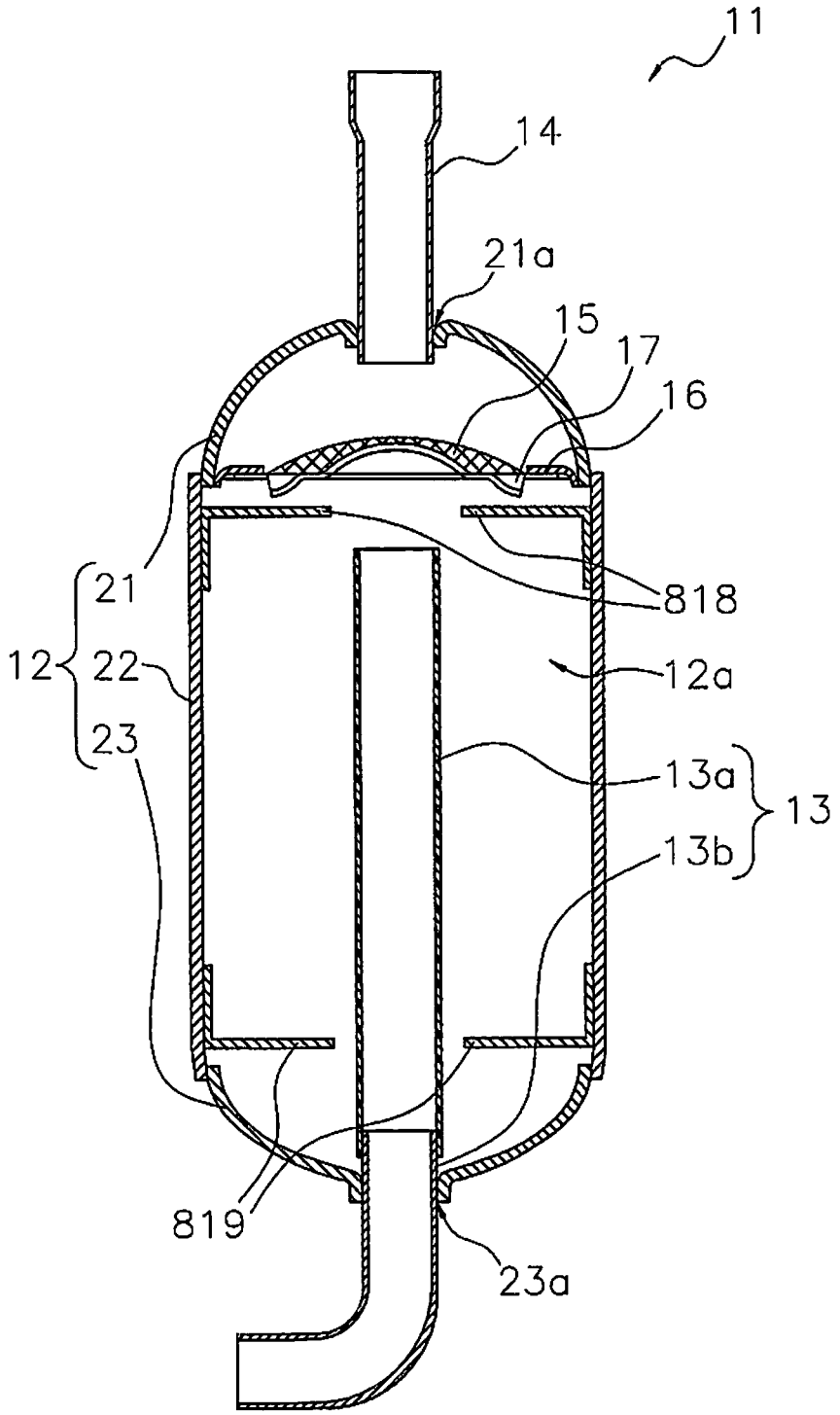
FIG. 23 is a longitudinal cross-sectional view of an accumulator according to Modification E.
Figure 24:
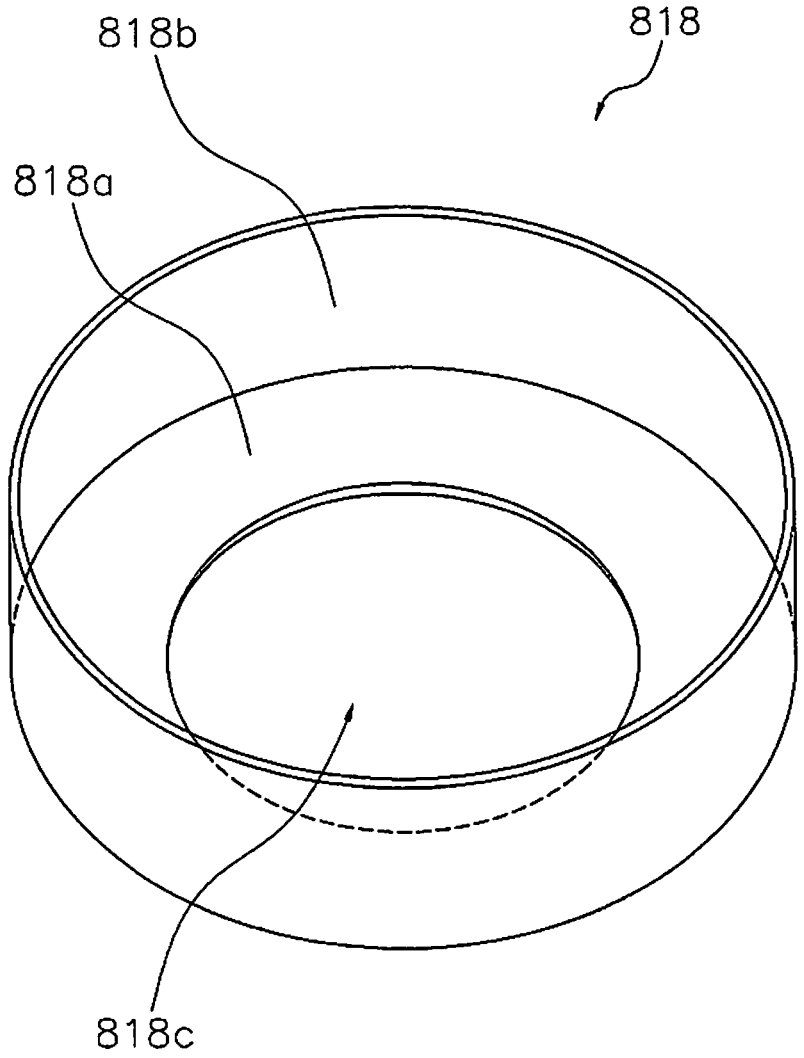
FIG. 24 is an external perspective view of an upper resonance-suppressing member according to Modification E.
Figure 25:
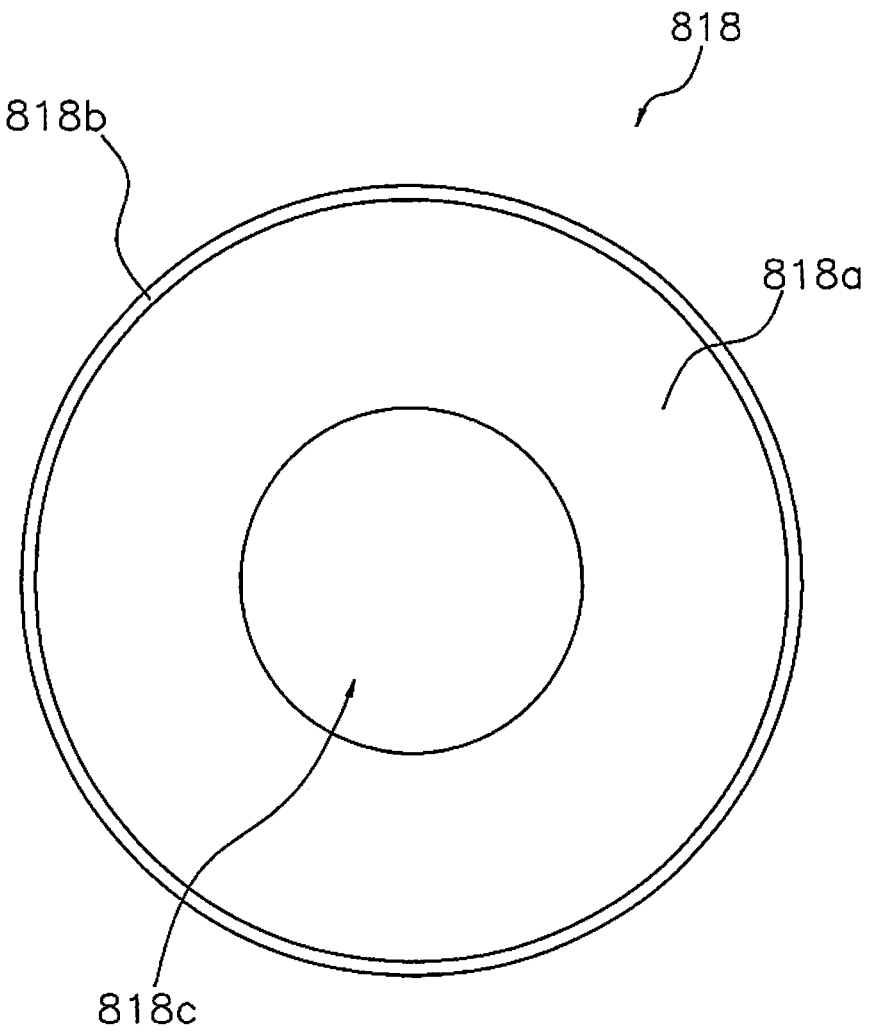
FIG. 25 is a top view of the upper resonance-suppressing member according to Modification E.

FIG. 23 is a longitudinal cross-sectional view of the accumulator 11 according to the present modification. The accumulator 11 is provided with an upper resonance-suppressing member 818 and a lower resonance-suppressing member 819 attached to the upper portion and lower portion of the casing 12, respectively. FIG. 24 is an external perspective view of the upper resonance-suppressing member 818. FIG. 25 is a top view of the upper resonance-suppressing member 818. The upper resonance-suppressing member 818 is configured from a bottom surface part 818*a* and a side wall part 818*b*. The bottom surface part 818*a* is an annular member equivalent to the upper resonance-suppressing member 18 of the present embodiment. A circular hole 818*c* is formed in the middle of the bottom surface part 818*a*. The side wall part 818*b* is a cylindrical member formed as standing upright from the outer edge of the bottom surface part 818*a*. The bottom surface part 818*a* and the side wall part 818*b* may be mutually separate members or integrated members. The external peripheral surface of the side wall part 818*b* of the upper resonance-suppressing member 818 is brought into contact with the internal peripheral surface of the casing 12, and the side wall part 818*b* and the casing 12 are joined by brazing, welding, or another method, whereby the upper resonance-suppressing member 818 is secured to the casing 12. The above description pertaining to the upper resonance-suppressing member 818 can also be applied to the lower resonance-suppressing member 819.

The present modification can be applied to Modifications A through D as well. For example, the bottom surface part 818*a* of the upper resonance-suppressing member 818 may have a hole in the shape of something other than a circle, and may have two or more holes. Specifically, the bottom surface part 818*a* of the upper resonance-suppressing member 818 may have the hole shown in FIG. 18, and the bottom surface part of the lower resonance-suppressing member 819 may have the holes shown in FIGS. 19 to 22.

(5-6) Modification F

In the present modification, the compression mechanism 115 of the compressor 101 is a swing-type compression mechanism, but this compression mechanism may be, e.g., a rotary-type compression mechanism or a scroll-type compression mechanism. The compression mechanism 115 may also be provided with a two-stage compression mechanism.

INDUSTRIAL APPLICABILITY

With the accumulator according to the present invention, resonance caused by pressure fluctuation in the internal space of the casing can be eliminated and noise can be reduced.

What is claimed is:

1. An accumulator configured to separate gas refrigerant and liquid refrigerant, the accumulator comprising:

a casing;

a baffle installed in an internal space of the casing;

an outlet tube extending vertically in the internal space of the casing; and a resonance-suppressing member installed in the internal space of the casing at a position axially spaced from the baffle, the resonance suppressing member being an annular metal member to form a hole, the outlet tube passing through the hole of the resonance-suppressing member without touching the resonance-suppressing member, the casing having a cylinder portion having a cylinder axis extending along a vertical direction, an upper lid portion linked with an upper end of the cylinder portion, and a lower lid portion linked with a lower end of the cylinder portion, the baffle being positioned above an upper end of the outlet tube, the resonance-suppressing member being positioned below the upper end of the outlet tube, and the resonance-suppressing member at least one of having only one hole, and forming a gap with an interior surface of the cylinder portion, the resonance-suppressing member being installed at a height position that, in a case in which a standing wave of pressure having a first antinode, a node, and a second antinode from the upper lid portion toward the lower lid portion is generated in the internal space, is near a height position of the second antinode, and the standing wave of pressure having only two antinodes and one node.

2. The accumulator according to claim 1, wherein the resonance-suppressing member is installed in a range from a height position of the lower end of the cylinder portion to a height position spaced by a distance of 25% of a dimension of the cylinder portion along the vertical direction of the cylinder axis from the lower end of the cylinder portion toward the upper end of the cylinder portion.

3. The accumulator according to claim 1, wherein the resonance-suppressing member is attached to an internal peripheral surface of the cylinder portion.

4. The accumulator according to claim 2, wherein the resonance-suppressing member is attached to an internal peripheral surface of the cylinder portion.

5. The accumulator according to claim 2, wherein the resonance-suppressing member is installed in the range from the height position of the lower end of the cylinder portion to a height position spaced by a distance of 12.5% of the dimension of the cylinder portion along the vertical direction of the cylinder axis from the lower end of the cylinder portion toward the upper end of the cylinder portion.

* * * * *